US011238793B2

(12) United States Patent
Meng et al.

(10) Patent No.: US 11,238,793 B2
(45) Date of Patent: Feb. 1, 2022

(54) PIXEL COMPENSATION METHOD AND SYSTEM, DISPLAY DEVICE

(71) Applicant: BOE TECHNOLOGY GROUP CO., LTD., Beijing (CN)

(72) Inventors: Song Meng, Beijing (CN); Zhongyuan Wu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/712,045

(22) Filed: Dec. 12, 2019

(65) Prior Publication Data

US 2020/0118492 A1 Apr. 16, 2020

Related U.S. Application Data

(63) Continuation-in-part of application No. PCT/CN2018/110154, filed on Oct. 12, 2018.

(30) Foreign Application Priority Data

Oct. 13, 2017 (CN) ..... 201710955277.3

(51) Int. Cl.
*G09G 3/3233* (2016.01)
*G09G 3/3225* (2016.01)

(52) U.S. Cl.
CPC ... *G09G 3/3233* (2013.01); *G09G 2310/0202* (2013.01); *G09G 2320/0204* (2013.01); *G09G 2320/0242* (2013.01)

(58) Field of Classification Search
CPC ..... G09G 3/3233; G09G 3/3225; G09G 2300/0819; G09G 2300/0842;
(Continued)

(56) References Cited

U.S. PATENT DOCUMENTS 9,076,387 B1 7/2015 Lee et al.
2007/0210996 A1 9/2007 Mizukoshi et al.
(Continued)

FOREIGN PATENT DOCUMENTS

CN 101354864 A 1/2009
CN 103871359 A 6/2014
(Continued)

OTHER PUBLICATIONS

International Search Report and Written Opinion issued in corresponding International Application No. PCT/CN2018/110154, dated Dec. 29, 2018, with English language translation.
(Continued)

*Primary Examiner* — David Tung
(74) *Attorney, Agent, or Firm* — McDermott Will and Emery LLP

(57) ABSTRACT

A pixel compensation method includes: detecting driving transistors of pixels to obtain present characteristic values of the driving transistors of the pixels; extracting historical compensation characteristic values of the driving transistors of the pixels obtained in a previous display cycle of a screen; calculating a present compensation characteristic value of at least one driving transistor of the pixels according to a present characteristic value and a historical compensation characteristic value corresponding to the driving transistor of the pixels; and compensating a corresponding pixel according to the present compensation characteristic value of the driving transistor of the pixels.

18 Claims, 14 Drawing Sheets

(58) Field of Classification Search
CPC ... G09G 2310/0202; G09G 2320/0204; G09G 2320/0242; G09G 2320/0693; G09G 2320/0295; G09G 2320/043; G09G 2320/048
See application file for complete search history.

(56) References Cited

U.S. PATENT DOCUMENTS

| | | | | |
|---|---|---|---|---|
| 2009/0027377 | A1 | 1/2009 | Kwon | |
| 2010/0225630 | A1 | 9/2010 | Levey et al. | |
| 2011/0050747 | A1* | 3/2011 | Ishii | G09G 3/3208 345/690 |
| 2014/0022289 | A1 | 1/2014 | Lee et al. | |
| 2014/0168184 | A1 | 6/2014 | Kim et al. | |
| 2014/0176409 | A1* | 6/2014 | Kim | G09G 3/3233 345/92 |
| 2015/0002502 | A1* | 1/2015 | Kim | G09G 3/3291 345/212 |
| 2015/0049075 | A1 | 2/2015 | Lim et al. | |
| 2015/0145845 | A1 | 5/2015 | Nam et al. | |
| 2015/0154908 | A1 | 6/2015 | Nam et al. | |
| 2016/0012800 | A1 | 1/2016 | Han et al. | |
| 2016/0078813 | A1* | 3/2016 | Mizukoshi | G09G 3/3291 345/76 |
| 2016/0104422 | A1* | 4/2016 | Kishi | G09G 3/006 345/205 |
| 2018/0190185 | A1 | 7/2018 | Ko et al. | |
| 2018/0226006 | A1 | 8/2018 | Wang et al. | |
| 2018/0322830 | A1 | 11/2018 | Xu | |

FOREIGN PATENT DOCUMENTS

| | | | |
|---|---|---|---|
| CN | 104424887 | A | 3/2015 |
| CN | 104637447 | A | 5/2015 |
| CN | 104658476 | A | 5/2015 |
| CN | 104700772 | A | 6/2015 |
| CN | 105023539 | A | 11/2015 |
| CN | 105243985 | A | 1/2016 |
| CN | 105321446 | A | 2/2016 |
| CN | 105679236 | A | 6/2016 |
| CN | 105702206 | A | 6/2016 |
| CN | 105895007 | A | 8/2016 |
| CN | 106531041 | A | 3/2017 |
| CN | 106856086 | A | 6/2017 |
| CN | 107025884 | A | 8/2017 |
| CN | 107170407 | A | 9/2017 |
| EP | 2 126 883 | | 12/2009 |
| EP | 3657480 | A1 | 5/2020 |

OTHER PUBLICATIONS

First Office Action issued in corresponding Chinese Application No. 201710955277.3, dated Jan. 22, 2020, with English language translation.

Partial Supplementary European Search Report issued in European Patent Application No. 18866389.2, dated Apr. 26, 2021.

Extended European Search Report issued in corresponding European Patent Application No. 18866389.2, dated Jul. 21, 2021.

* cited by examiner

PIXEL COMPENSATION METHOD AND SYSTEM, DISPLAY DEVICE

CROSS-REFERENCE TO RELATED APPLICATIONS

This application is a Continuation in part of Application of PCT/CN2018/110154 filed on Oct. 12, 2018, which claims priority to and benefits of Chinese Patent Application No. 201710955277.3 filed on Oct. 13, 2017, which are incorporated herein by reference in their entirety.

TECHNICAL FIELD

The present disclosure relates to the field of display technologies, and in particular, to a pixel compensation method, a pixel compensation system, and a display apparatus.

BACKGROUND

A display apparatus is an apparatus for displaying characters, numbers, symbols, pictures, or images formed by combining at least two of characters, numbers, symbols, and pictures, providing great convenience for people's life and work.

SUMMARY

In a first aspect, some embodiments of the present disclosure provide a pixel compensation method. The pixel compensation method includes: detecting driving transistors of pixels to obtain present characteristic values of the driving transistors of the pixels; extracting historical compensation characteristic values of the driving transistors of the pixels obtained in a previous display cycle of a screen; calculating a present compensation characteristic value of at least one driving transistor of the pixels according to a present characteristic value and a historical compensation characteristic value corresponding to the driving transistor of the pixels; and compensating a corresponding pixel according to the present compensation characteristic value of the driving transistor of the pixels.

In a second aspect, some embodiments of the present disclosure provide a pixel compensation system. The pixel compensation system includes a main control chip, a gate driver and a source driver. The main control chip is electrically connected to the gate driver and the source driver, and the gate driver and the source driver are configured to be electrically connected to a pixel circuit, which includes a driving transistor, of each pixel. The main control chip is configured to obtain present compensation characteristic values P of driving transistors of pixels. The gate driver and the source driver are configured to compensate corresponding pixels using the obtained present compensation characteristic values P of the driving transistors of the pixels.

In a third aspect, some embodiments of the present disclosure provide a display apparatus, which has a display area and a non-display area. The display apparatus includes gate lines and data lines disposed in the display area. The gate lines and the data lines are arranged crosswise without direct contact to form a plurality of pixels arranged in an array, and each pixel includes a driving transistor. The display apparatus includes following elements disposed in the non-display area: a gate driver electrically connected to the gate lines; a source driver electrically connected to the data lines; a memory configured to store program codes including operation instructions; and one or more main control chips electrically connected to the gate driver, the source driver and the memory. The one or more main control chips are configured to, when executing the operation instructions, perform the pixel compensation method according to the first aspect and drive each driving transistor to perform a corresponding action.

BRIEF DESCRIPTION OF THE DRAWINGS

The accompanying drawings are used to provide further understanding of the present disclosure and constitute a part of the present disclosure. The exemplary embodiments in the present disclosure and the descriptions thereof serve to explain the present disclosure, but do not constitute a limitation to the present disclosure. In the accompanying drawings.

DETAILED DESCRIPTION

In order to make the objects, technical solutions and advantages of embodiments of the present disclosure clearer, the technical solutions in the embodiments of the present disclosure will be described clearly and completely with reference to the accompanying drawings in the embodiments of the present disclosure. Obviously, the described embodiments are merely some but not all of embodiments of the present disclosure. All other embodiments made on the basis of the embodiments of the present disclosure by a person of ordinary skill in the art without paying any creative effort shall be included in the protection scope of the present disclosure.

Some embodiments of the present disclosure provides a pixel compensation method, which may be applied to a display apparatus. The display apparatus may be a display, a television, a mobile phone, a tablet computer, a game machine, a personal digital assistant (PDA), etc.

Figure 16:
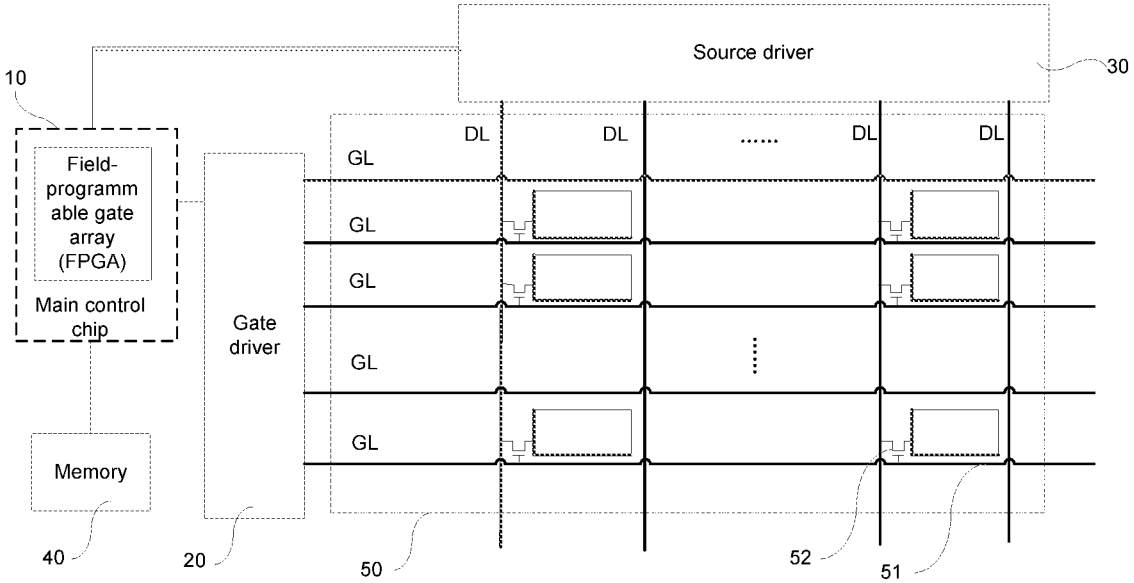
FIG. 16 is a schematic diagram showing a structure of a display apparatus, in accordance with some embodiments.

In some embodiments, as shown in FIG. 16, the display apparatus has a display area 50 and a non-display area located around the display area 50. The display apparatus includes gate lines GL and data lines DL that are all disposed in the display area 50. The gate lines GL and the data lines DL are arranged crosswise without direct contact to form a plurality of pixels 51 arranged in an array. At least one pixel 51, such as each pixel 51, includes a pixel circuit, and the pixel circuit includes a driving transistor. In addition, the pixel circuit may further include a light-emitting device. The display apparatus further includes sensing lines, one of which is electrically connected to the driving transistor and the light-emitting device. The driving transistor may be a thin film transistor, such as a poly-silicon thin film transistor like a low temperature poly-silicon thin-film transistor (LTPS TFT), a single crystal silicon thin film transistor, an amorphous silicon thin film transistor, or a metal oxide thin film transistor.

The display apparatus further includes a main control chip 10, a gate driver 20, a source driver 30 and a memory 40 that are all disposed in the non-display area. The main control chip 10 is, for example, a field programmable gate array (FPGA). The FPGA is similar to a processor, and is capable of performing various operations. The main control chip 10 may also be implemented as an application-specific integrated circuit (ASIC) chip.

The gate driver 20 and the source driver 30 are execution units that transmit signals to corresponding driving transistors 52 respectively through the gate lines GL and the data lines DL in response to instructions sent by the main control chip 10, so as to drive the driving transistors 52 to perform corresponding actions. For example, the gate driver 20 transmits a signal to driving transistors electrically connected to a gete line GL, so that the driving transistors in this row are turned on. Next, the source driver 30 outputs a data signal to a source or drain of one of the driving transistors to control the pixel to emit light.

The memory 40 stores data for retrieval and use by the main control chip 10. The memory 40 is, for example, a flash memory, which is a non-volatile memory, in which data will not be lost after power-off. In another exmaple, the memory 40 is a data documentation initiative (DDI) memory, which is a high-speed memory, in which data will be lost after power-off.

Figure 2:
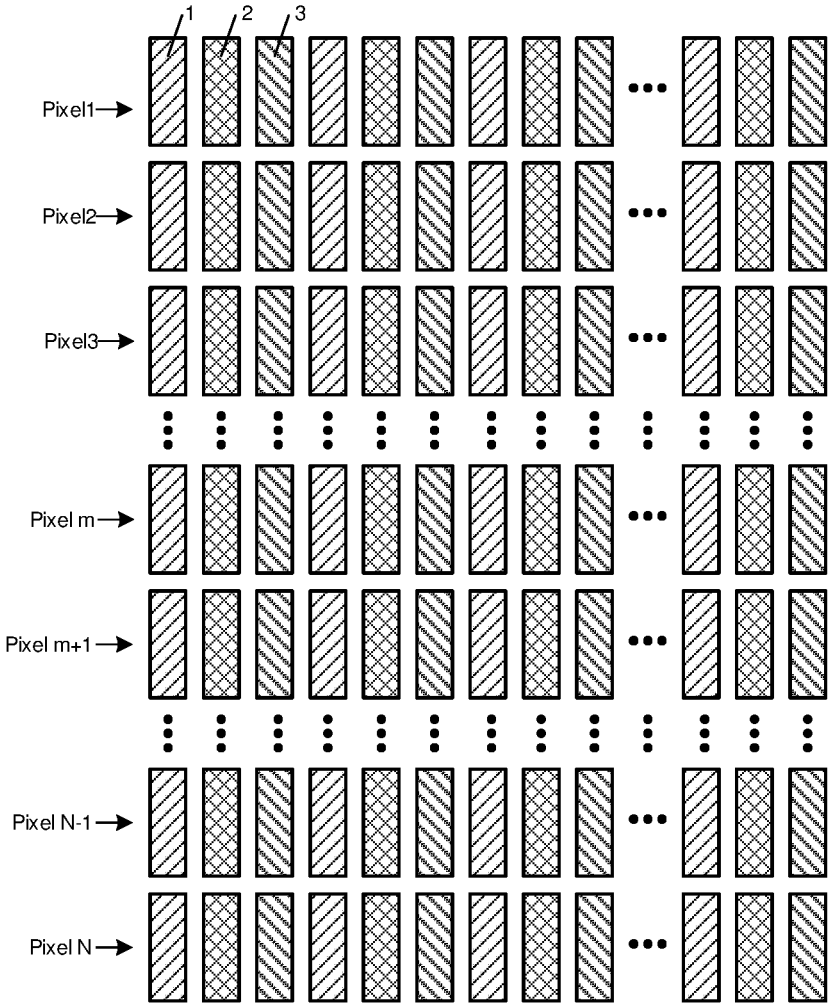
FIG. 2 is a schematic diagram of an arrangement of pixels in a display apparatus, in accordance with some embodiments.
Figure 11:
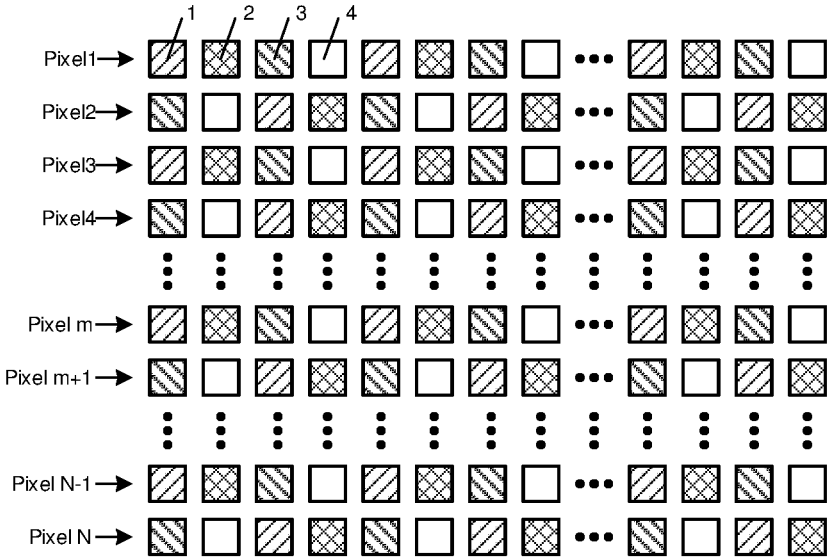
FIG. 11 is a diagram of a second arrangement of pixels in a display apparatus, in accordance with some embodiments.

Each gate line GL corresponds to a row of pixels 51. For example, as shown in FIG. 2, the display apparatus adopts an RGB (i.e., red, green and blue) color mode, and each row of pixels are sequentially and repeatedly arranged in an order of R pixel 1, G pixel 2 and B pixel 3. For another example, as shown in FIG. 11, the display apparatus adopts an RGBW (i.e., red, green, blue and white) color mode, and each row of pixels are sequentially and repeatedly arranged in an order of R pixel 1, G pixel 2, B pixel 3 and W pixel 4.

The display apparatus is configured to display a frame of image in a manner of progressive scanning. In a case where the display apparatus has N gate lines GL, the gate lines GL are sequentially scanned from a first gate line to an Nth gate line in a display period of the certain frame of image. In this way, all rows of pixels sequentially emit light from a first row to an Nth row, thereby displaying the frame of image. When the gate lines GL are sequentially scanned from the first gate line to the Nth gate line again in a display period of a next frame of image, the next frame of image is displayed. A period of time is reserved between scanning times of two adjacent frames of images, and this period of time is referred to as a blanking time.

For example, the display apparatus has 2160 gate lines (i.e., N=2160), but in fact 2250 gate lines are scanned. Scanning times of the extra 90 gate lines (which are 90 gate lines in the 2160 gate lines) correspond to the blanking time. At a scanning frequency of 60 Hz per second, a time taken to scan one frame of image is (1/60) second. In the (1/60) second, a time taken to scan 2160 gate lines is [(1/60) second×(2160/2250)], and the blanking time is [(1/60) second×(90/2250)].

Depending on a driving mode of the pixels, the pixels may be classified into voltage-driven pixels and current-driven pixels. As for a display apparatus including current-driven pixels, a display quality of the display apparatus is usually affected by currents applied to the pixels.

For example, as for an active matrix organic light-emitting diode (AMOLED) display apparatus, the display quality of the display apparatus is usually affected by currents applied to OLED pixels. Due to factors such as a manufacturing process and a sensitivity to temperature of driving transistors (for example, thin film transistors) of the OLED pixels, characteristics of the driving transistors (such as threshold voltages, mobilities, and scaling factors in a current-voltage formula of the thin film transistors) of the OLED pixels in the display apparatus usually change when the display apparatus operates. As a result, the currents applied to the OLED pixels may be uneven and may not be matched with an image to be displayed, thereby causing the display quality of the display apparatus to be poor.

In order to compensate for changes in characteristics of a driving transistor of a pixel when the display apparatus operates, the pixel may be compensated. When compensating the pixel, a present compensation characteristic value P of the driving transistor in the pixel is obtained first, and then the pixel is compensated according to the present compensation characteristic value P. This is to avoid a situation in which the changes in the characteristics of the driving transistor cause an electrical signal applied to the pixel to be uneven and not match the image to be displayed during operation of the display apparatus. In some embodiments, this method is suitable for the display apparatus including current-driven pixels (such as OLED pixels).

The pixel compensation method described below may be implemented in the display apparatus described above.

Figure 3:
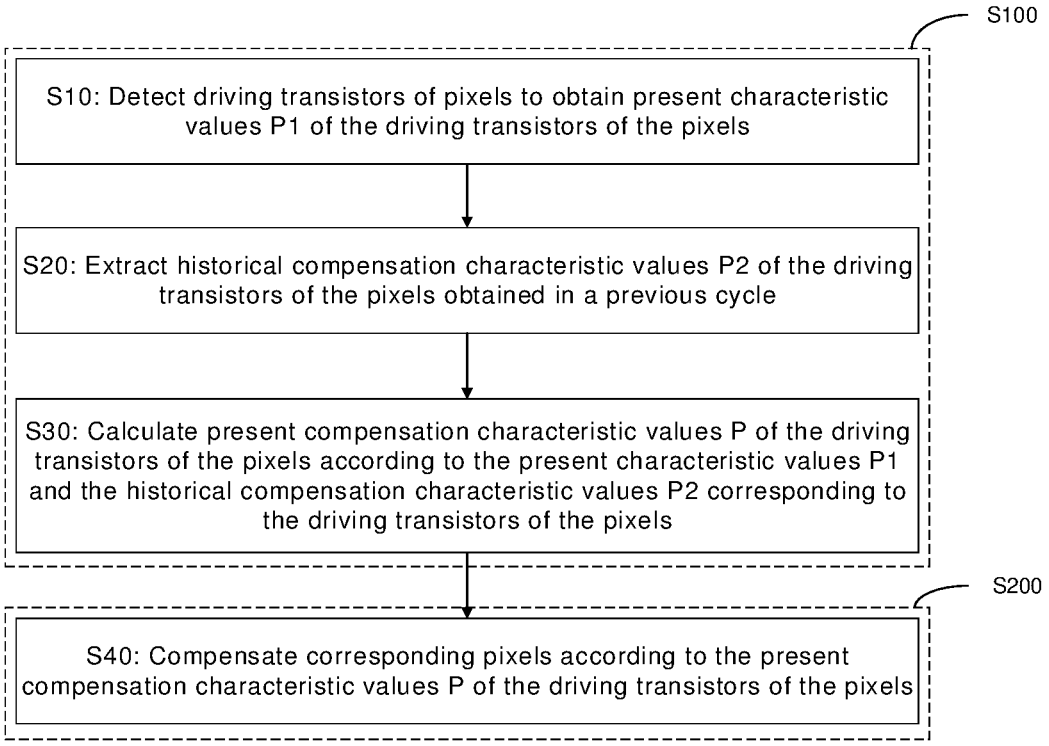
FIG. 3 is a flow diagram of a pixel compensation method, in accordance with some embodiments.

Some embodiments of the present disclosure provide a pixel compensation method. As shown in FIG. 3, the method includes S100 and S200.

In S100, present compensation characteristic values P of driving transistors of pixels are obtained.

A present compensation characteristic value P of a driving transistor of a pixel may be obtained according to the threshold voltage of the driving transistor, or may be obtained according to the mobility of the driving transistor, or may be obtained according to the scaling factor in the current-voltage formula of the driving transistor.

In S200, according to the present compensation characteristic values P, corresponding pixels are compensated.

That corresponding pixels are compensated means that data voltages to be applied to the pixel circuits of the corresponding pixels are compensated.

The present compensation characteristic values P of the driving transistors of the pixels are obtained, and then the corresponding pixels are compensated according to the present compensation characteristic values P. Therefore, during operation of the display apparatus, when applying currents to the pixels, possible changes in the characteristics of the driving transistors are taken into account. As a result, the currents applied to the pixels may be more even, and may match the image to be displayed, thereby enhancing the display quality of the display apparatus.

In S100, the present compensation characteristic values P of the driving transistors of the pixels may be obtained by a plurality of implementations.

Implementation 1

For example, the driving transistors of the pixels are detected to obtain present characteristic values P1 of the driving transistors, and the present characteristic values P1 of the driving transistors are directly used as the present compensation characteristic values P of the driving transistors.

In some examples, the present characteristic value P1 of the driving transistor is a threshold voltage of the driving transistor. In some other examples, the present characteristic value P1 of the driving transistor includes the threshold voltage of the driving transistor and a first detection value. The first detection value is a value of a voltage on the sensing line read after the sensing line is charged for a first preset time in a case where a test voltage is applied to the gate of the driving transistor. The test voltage is a sum of the threshold voltage and a first preset voltage.

The threshold voltage of the driving transistor is obtained, for example, by reading from a memory (the data may be from, for example, factory settings, user settings and actual test results, and may not be limited thereto), by detecting the pixel circuit, or receiving from an external device, and the method may not be limited thereto.

The first detection value is obtained, for example, by reading from a memory, by detecting the pixel circuit, or by receiving from an external device, and the method may not be limited thereto.

Since the test voltage is the sum of the threshold voltage $V_{th}$ and the first preset voltage $V_0$, a formula of a source-drain current $I_{DS}$ of the driving transistor obtained when the test voltage is applied to the gate of the driving transistor is as follows (for a sake of simplicity, a potential on the sensing line is set to be a reference potential, which is a zero voltage, the same below).

$$I_{DS}=K(V_0+V_{th}-V_{th})^2=KV_0^2$$

Figure 17:
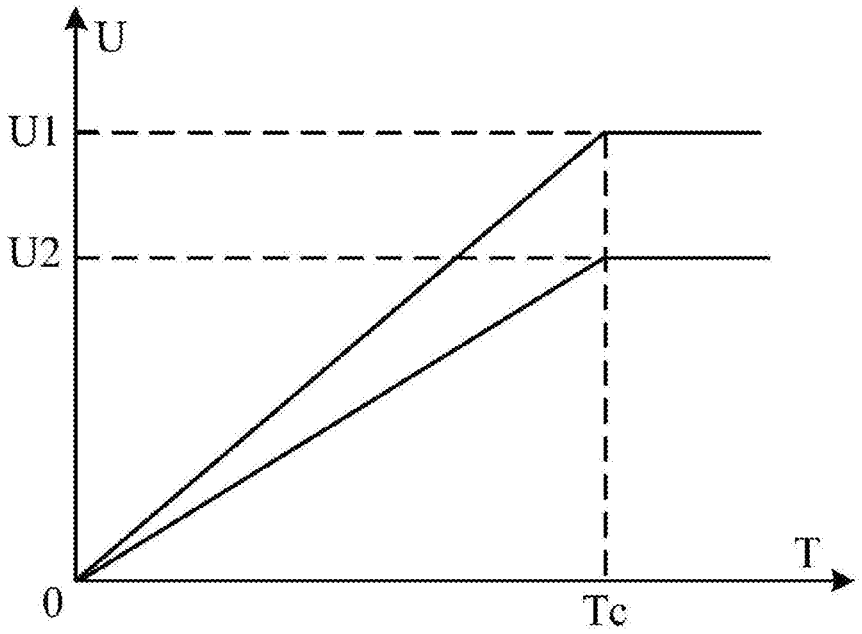
FIG. 17 is a schematic diagram showing a voltage change with time in a process of charging a capacitor, in accordance with some embodiments.

It will be seen that, the source-drain current $I_{DS}$ is independent of the threshold voltage $V_{th}$, and is only related to the first preset voltage $V_0$ (a known set value) and a parameter K. Moreover, since the sensing line is electrically connected to the driving transistor and the organic light-emitting diode, the source-drain current $I_{DS}$ of the driving transistor can charge the sensing line (in this case, the sensing line is equivalent to one terminal of a capacitor) when the organic light-emitting diode remains in a non-light-emitting state (for example, a reverse bias state). In a case where a charging time, i.e., the first preset time, is sufficiently short, a voltage on the sensing line obtained after the sensing line is charged is positively correlated with the source-drain current $I_{DS}$. For example, as shown in FIG. 17 (a horizontal coordinate is the time T and a vertical coordinate is the voltage U), charging currents of different magnitudes are used to charge a same capacitor for a same period of time Tc and then the charging is stopped. In this process, since rising rates of the voltages U are different from each other due to influences of the magnitudes of the charging currents, after charging the same capacitor for the same period of time Tc, a higher voltage U1 and a lower voltage U2 are reached. That is, magnitudes of the voltages reached are positively correlated with the magnitudes of the charging currents. Therefore, the first detection value may reflect a magnitude of the parameter K to some extent. The parameter K is:

$$K=\frac{1}{2}\cdot\frac{W}{L}\cdot\mu\cdot C_{ox}$$

That is, the parameter K is a parameter related to a channel width W, a channel length L and a carrier mobility U of the driving transistor and a capacitance $C_{ox}$ per unit area of a gate insulating layer. Therefore, the first detection value, which is obtained based on the process of reading the value of the voltage on the sensing line after the sensing line is charged for the first preset time in the case where the test voltage is applied to the gate of the driving transistor, may reflect a difference in the magnitudes of the parameters K of the driving transistors in different pixel circuits, and becomes another parameter related to the driving transistor other than the threshold voltage of the driving transistor.

Figure 18:
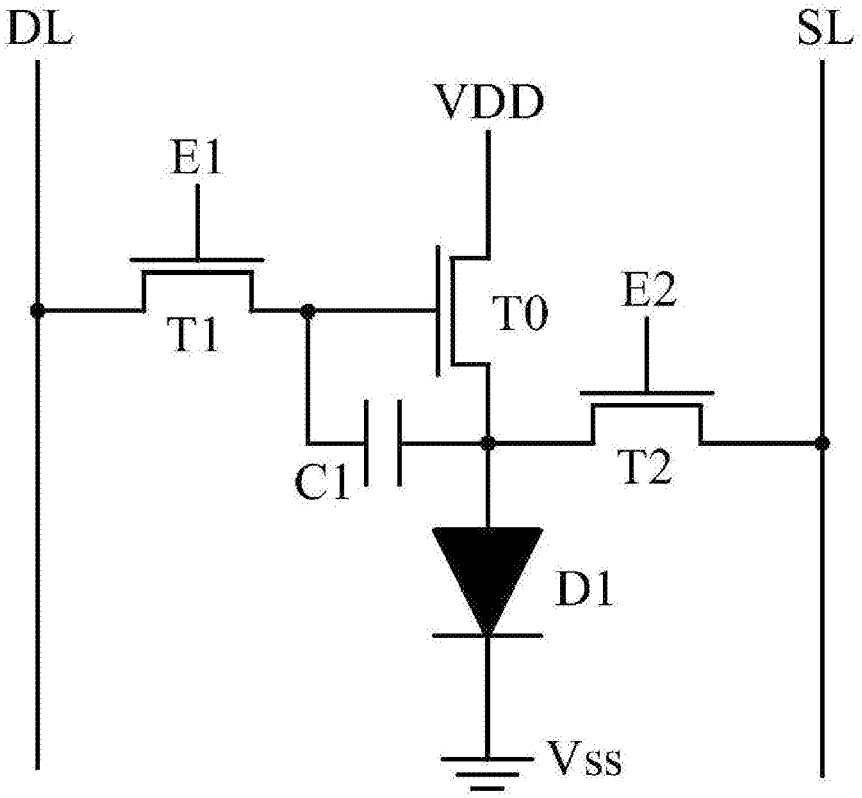
FIG. 18 is a circuit diagram of a pixel circuit, in accordance with some embodiments.

In some embodiments, as shown in FIG. 18, the pixel circuit includes a driving transistor T0, a first transistor T1, a second transistor T2, a storage capacitor C1, and an organic light-emitting diode D1. A gate of the first transistor T1 is electrically connected to a first scan line E1 extending in a row direction, a first electrode of the first transistor T1 is electrically connected to a data line DL, and a second electrode of the first transistor T1 is electrically connected to a gate of the driving transistor T0. The first transistor T1 may be turned on or off under control of a voltage signal from the first scan line E1 to correspondingly turn on or off the communication between the data line DL and the gate of the driving transistor T0. A gate of the second transistor T2 is electrically connected to a second scan line E2 extending in the row direction, a first electrode of the second transistor T2 is electrically connected to a second electrode of the driving transistor T0 and a first electrode of the organic light-emitting diode D1, and a second electrode of the second transistor T2 is electrically connected to the sensing line SL. The second transistor T2 may be turned on or off under control of a voltage signal from the second scan line E2 to correspondingly turn on or off the communication between the second electrode of the driving transistor T0 and the sensing line SL. The storage capacitor C1 is electrically connected to the gate and the second electrode of the driving transistor T0, and is capable of storing the data voltage applied to the pixel circuit and has a function of clamping between the gate and the second electrode of the driving transistor T0. In addition, a first electrode of the driving transistor TO is electrically connected to a bias voltage line VDD, and a second electrode of the organic light-emitting diode D1 is electrically connected to a reference voltage line Vss.

In some embodiments, the first electrode and the second electrode of each transistor described above are respectively a source and a drain. In some other embodiments, the first electrode and the second electrode of each transistor described above are respectively a drain and a source. According to different types of the transistors, coupling relationships that the sources and the drains respectively have may be set to match directions of currents flowing through the transistors. In a case where a transistor has a structure in which the source and the drain are symmetrical, the source and the drain may be regarded as two electrodes that are not particularly distinguished from each other.

In some embodiments, the pixel circuits included in the display apparatus are arranged in an array having a plurality of rows and a plurality of columns. Pixel circuits in each row share a same first scan line E1 and a same second scan line E2. Pixel circuits in each column share a same sensing line SL and a same data line DL. Thus, at least one of a loading of the data voltage, the data compensation and a detection of a present compensation characteristic value P performed by the pixel circuits may be performed in a row and column addressing manner.

In some embodiments, a method for acquiring the first detection value in the present compensation characteristic value P includes: reading the value of the voltage on the sensing line as the first detection value after the sensing line is charged for the first preset time in the case where the test voltage is applied to the gate of the driving transistor.

For example, in the pixel circuit shown in FIG. 18, the first transistor T1 and the second transistor T2 are turned on respectively under control of voltage signals from the first scan line E1 and the second scan line E2, and the test voltage from the data line DL is applied to the gate of the driving transistor T0. Next, the sensing line SL may be placed in a floating state from a moment. That is, a current flowing through the first and second electrodes of the driving transistor T0 from the bias voltage line VDD and flowing through the first and second electrodes of the second transistor T2 starts to charge the sensing line SL. Next, the second transistor T2 is turned off under control of a voltage signal from the second scan line E2 after an end of the first preset time, and the value of the voltage on the sensing line SL is read as the first detection value. As described above, the first detection value may reflect the difference in the magnitudes of the parameters K of the driving transistors in different pixel circuits.

In some examples, the above process of reading the value of the voltage on the sensing line as the first detection value after the sensing line is charged for the first preset time in the case where the test voltage is loaded into the gate of the driving transistor is as follows.

Figure 19:
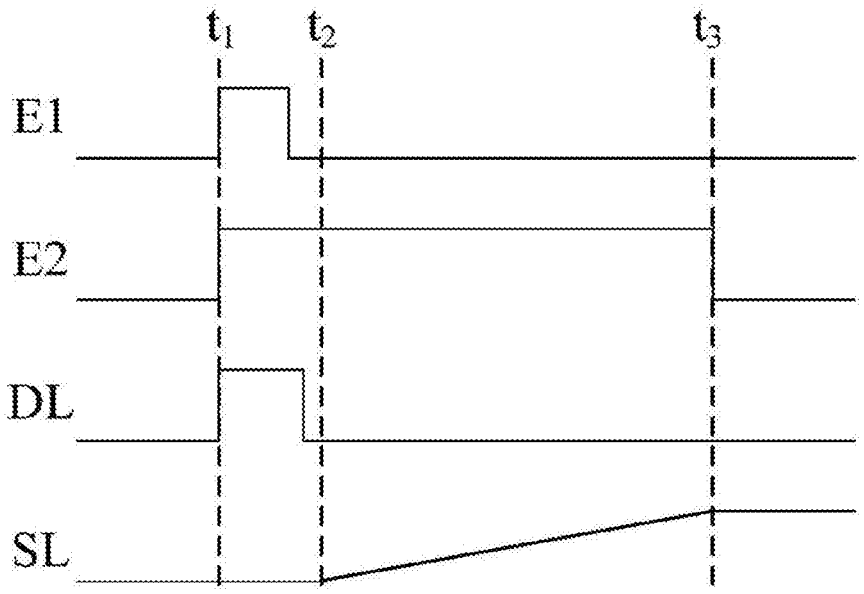
FIG. 19 is a timing diagram of a pixel circuit, in accordance with some embodiments.

Referring to FIGS. 18 and 19, at a first moment $t_1$, a high level voltage is started to be applied to the first scan line E1 to turn on the first transistor T1, and a high level voltage is started to be applied to the second scan line E2 to turn on the second transistor T2. At the same time, the test voltage is started to be applied to the data line DL. Thereby, after a voltage that is the same as the test voltage is written into the storage capacitor C1, the voltage across the storage capacitor C1 will maintain at a same voltage as the test voltage. At a second moment $t_2$ when the high level voltage on the first scan line E1 has been changed to a low level voltage, and the test voltage has been stopped being applied to the data line DL, the gate of the driving transistor T0 is in a floating state (in some embodiments, a moment at which the test voltage is stopped being applied to the data line DL or a moment at which the voltage on the first scan line E1 is changed from a turn-on voltage of the first transistor T1 to a turn-off voltage may also be set as the second moment $t_2$). The voltage across the storage capacitor C1 is continuously maintained as the test voltage under a charge retention effect of the storage capacitor C1, so that the source-drain current of the driving transistor T0 that starts charging the sensing line SL from the second moment $t_2$ at which the sensing line SL is placed in the floating state will be maintained constant independent of the threshold voltage. As a charging process continues, a potential on the sensing line SL will rise at a constant rate until a third moment $t_3$ at which the high level voltage on the second scan line E2 is changed to a low level voltage. It will be seen that, the value of the voltage on the sensing line SL, i.e., the first detection value, is a product of a difference of $t_3$ and $t_2$ (i.e., the first preset time) and the above constant source-drain current. It will be inferred that, the first detection value is independent of the threshold voltage of the driving transistor T0, and may reflect the magnitude of the above parameter K of the driving transistor T0.

It will be understood that, a setting of the first preset time may be achieved through a setting of the second moment at which the sensing line is started to be placed in the floating state and/or a setting of a moment at which the voltage on the second scan line E2 is changed from a turn-on voltage of the second transistor T2 to a turn-off voltage. Moreover, in order to avoid that a capacitance on the sensing line SL is prematurely filled and thus the first detection value cannot accurately reflect the magnitude of the parameter K, the first preset time may be set according to a magnitude of the capacitance on the sensing line SL, so that the voltage on the sensing line SL still rises at a constant rate before the third moment $t_3$.

Figure 20:
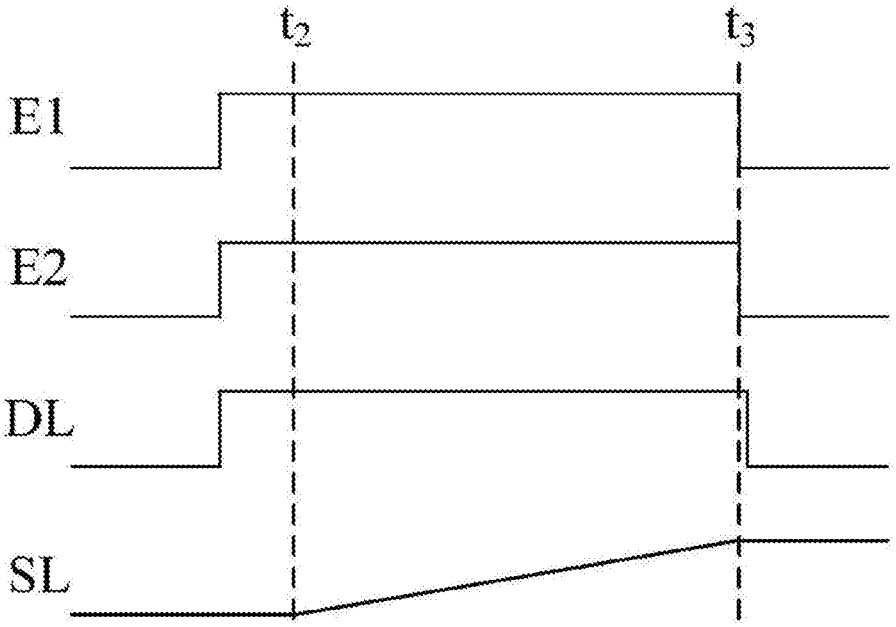
FIG. 20 is a timing diagram of a pixel circuit, in accordance with some embodiments.

In some examples, based on the above method, a timing of the circuit shown in FIG. 19 may be changed to a timing of the circuit shown in FIG. 20. That is, in a period of time between the second moment $t_2$ and the third moment $t_3$, the voltage on the first scan line E1 is maintained as the turn-on voltage of the first transistor T1, and a loading of the test voltage into the data line DL is maintained in this period of time. Thus, the voltages on both ends of the storage capacitor C1 will be changed in the period of time between the second moment $t_2$ and the third moment $t_3$. In a case where the period of time is long enough, the potential on the sensing line SL will rise fast first and then rise slowly. However, by setting the first preset time to be sufficiently short, the rising rate of the voltage on the sensing line SL in the period of time between the second moment $t_2$ and the third moment $t_3$ may be approximately considered to be constant. That is, the first detection value may still be obtained, and it is considered that the first detection value reflects the magnitude of the above parameter K corresponding to the driving transistor T0. Of course, the above method of reading the first detection value is an illustrative example, and an implementation of the method may not be limited thereto.

In some examples, the threshold voltage of the driving transistor is obtained according to a second detection value and a second preset voltage. The second detection value is a value of a voltage on the sensing line read after the sensing line is charged for a second preset time in a case where the second preset voltage is loaded into the gate of the driving transistor. It will be understood that, a process of obtaining the threshold voltage (e.g., reading a data item corresponding to the threshold voltage from the memory) and a process of obtaining the first detection value (e.g., reading the data item corresponding to the threshold voltage from the memory) may be in no particular order within an achievable range. A process of reading the first detection value and a process of reading the second detection value may also be in no particular order within an achievable range. It will be noted that, the threshold voltage in the test voltage used to read the first detection value at any time may be obtained at any moment before the test voltage is loaded. It is permissible, but is not necessary, to first load the second preset voltage to obtain a latest threshold voltage before each time the test voltage is loaded to obtain the first detection value.

In some examples, the threshold voltage is obtained by using the above method, and the above method may further include the following steps. After the sensing line is charged for the second preset time in the case where the second preset voltage is applied to the gate of the driving transistor, the value of the voltage on the sensing line is read as the second detection value. The second preset voltage and the second detection value are used to calculate the threshold voltage of the driving transistor. For example, the threshold voltage of the driving transistor is a difference between the second preset voltage and the second detection value.

Figure 21:
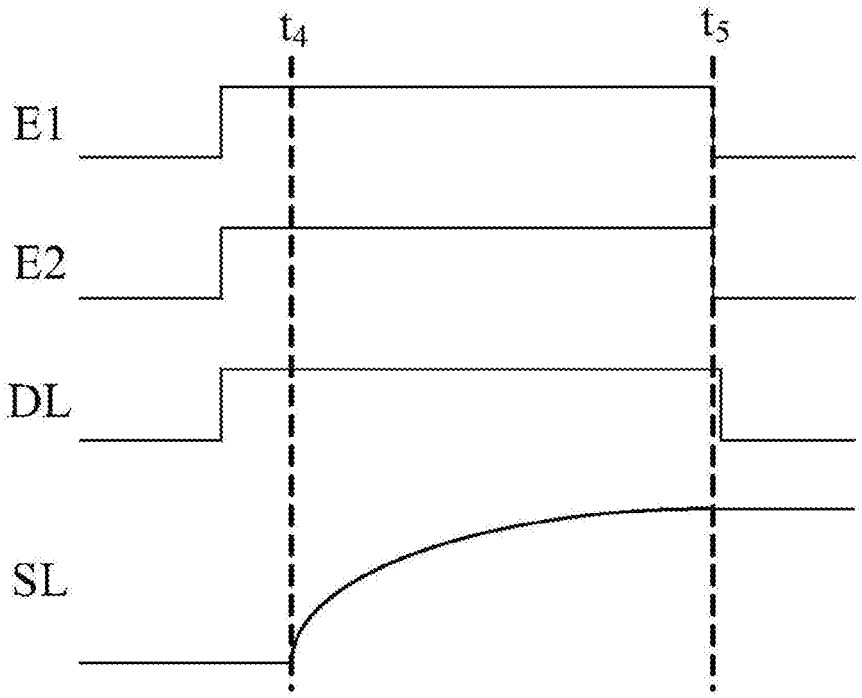
FIG. 21 is a timing diagram of a pixel circuit, in accordance with some embodiments.

Taking the circuit structure shown in FIG. 18 as an example, referring to FIG. 21, before a fourth moment $t_4$, the first transistor T1 and the second transistor T2 are turned on under control of voltage signals from the first scan line E1 and the second scan line E2 respectively, and the second preset voltage from the data line DL is applied to the gate of the driving transistor T0. Moreover, the sensing line SL is in the floating state at the fourth moment t4, so that the current flowing through the first and second electrodes of the driving transistor T0 from the bias voltage line VDD and flowing through the first and second electrodes of the second transistor T2 starts to charge the sensing line SL. It will be understood that, in a case where no current flows through both ends of the organic light-emitting diode D1, the charging process will cause a potential on the second electrode of the driving transistor T0 and the potential on the sensing line SL to continuously rise until the driving transistor is turned off. Thereafter, a difference in a potential on the gate of the driving transistor T0 and the potential on the second electrode of the driving transistor T0 is always kept equal to the threshold voltage. Therefore, by setting time between the fifth moment t5 at which the voltage on the second scan line E2 is changed from the turn-on voltage of the second transistor T2 to the turn-off voltage and the fourth moment t4 (i.e., setting the second preset time to be sufficiently long), the threshold voltage of the driving transistor T0 may be obtained by subtracting the second detection value read by the sensing line SL from the second preset voltage applied to the gate of the driving transistor T0. It will be noted that, one way to make no current flow through both ends of the organic light-emitting diode D1 is to set another transistor to decouple the second electrode of the driving transistor T0 from the first electrode of the organic light-emitting diode D1 in the above process, and may not be limited thereto.

Based on the above steps, the magnitude of the threshold voltage of the driving transistor may be obtained. In addition, in a case where the plurality of pixel circuits in the display apparatus are arranged in an array, threshold voltages corresponding to pixel circuits in the rows may be obtained row by row through the row and column addressing. Moreover, in addition to directly obtaining the threshold voltage from the difference between the second preset voltage and the second detection value, a measurement accuracy of the threshold voltage may also be improved by, for example, theoretically correcting the value of the voltage on the sensing line read and/or filtering out noise signals, and a method of improving the measurement accuracy of the threshold voltage may not be limited thereto.

In any of the above methods, the threshold voltage of the driving transistor and/or the first detection value may be updated when preset conditions are satisfied, and thus the data voltage to be applied to the pixel circuit may be compensated according to a combination of a first detection value and a threshold voltage that are last updated. The detection of the present compensation characteristic value P for each pixel circuit may be performed once each time the preset conditions are satisfied.

It will be understood that, the preset conditions may be set according to actual needs. For example, the preset conditions may include any one or more of: receiving the control command for updating the present compensation characteristic value P, the display apparatus being turned on, the display apparatus receiving the turn-off command, at the present moment which is the first moment before the start of every n frames displayed (n is a positive integer), and at the present moment which is the second moment as the beginning of each timer cycle, so as to balance the compensation effect of improving the display uniformity and updating an overhead.

In some examples, in a case where the display apparatus has N rows of pixels capable of displaying a frame of image, and n rows of pixels corresponding to the blanking time(s) (the n rows of pixels are pixels in the N rows of pixels, that is, n is greater than 0 and is less than N), scanning each frame of image includes: scanning for displaying a frame of image and scanning for obtaining the present characteristic values P1. For example, in a display period [(1/60) seconds] of a present frame of image: in a first [N/(N+n)] time (display scanning time), the pixels are scanned from a first row of pixels Pixel1 to an Nth row of pixels PixelN, so as to display the present frame of image; in a latter [n/(N+n)] time (blanking time), one row of pixels in the first row of pixels Pixel1 to the Nth row of pixels PixelN are scanned, so as to obtain present characteristic values P1 of the scanned one row of pixels. That is, n is equal to 1.

Similarly, in a display period [(1/60) seconds] of a next frame of image: in the first [N/(N+n)] time, the pixels are scanned from the first row of pixels Pixel1 to the Nth row of pixels PixelN, so as to display the next frame of image; in the latter [n/(N+n)] time, a next row of pixels (i.e., the next row of pixels of the one row of the pixels) in the first row of pixels Pixel1 to the Nth row of pixels PixelN are scanned, so as to obtain present characteristic values P1 of the scanned next row of pixels.

The rest may be deduced by analogy. In this example, since there is only one blanking time between every two frames of images, and only one row of pixels are scanned in each blanking time to obtain the present characteristic values P1 of the row of pixels, in order to obtain the present characteristic values P1 of each row of pixels, all the pixels are scaned from the first row of pixels Pixel1 to the Nth row of pixels PixelN in N blanking times (because it requires N blanking times to scan all N rows of pixels), so as to detect each row of pixels that are scanned, and thus obtain the present characteristic values P1 of each row of pixels. This operation of scanning pixels from the first row of pixels Pixel1 to the Nth row of pixels PixelN in a plurality of blanking times for obtaining the present characteristic values P1 of each row of pixels is referred to as scanning of a display cycle of a screen. In a case where the display apparatus has 2160 rows of pixels and a refresh frequency is 60 Hz, a time taken to complete the scanning of a display cycle of the screen is 2160/60=36 seconds.

In some other examples, a scanning time of each frame of image may include two or more blanking times, without being limited to the one blanking time in the above example. Alternatively, the blanking time is not limited to be at an end of the scanning time of each frame of image in the above example, that is, the blanking time is not limited to the above latter [n/(N+n)] time. Alternatively, in the one blanking time described above, two or more rows of pixels in the first row of pixels Pixel1 to the Nth row of pixels PixelN may be scanned, and it is not limited that only one row of pixels are scanned.

That is to say, in a case where the present characteristic values P1 are directly used as the present compensation characteristic values P to compensate the pixels, in at least one blanking time of a present display cycle of the screen, all pixels from the first row of pixels Pixel1 to the Nth row of pixels are sequentially scanned (which is referred to as scanning for obtaining the present characteristic values P1).

In the present display cycle of the screen, every time a blanking time is over, a display period of a next frame of image is entered. In the display period of the next frame of image, when compensating at least one row of pixels already scanned in the present display cycle of the screen, compensation data used is the present characteristic values P1 that have been obtained in the present display cycle of the screen; and when compensating other rows of pixels that are not scanned in the present display cycle of the screen, compensation data used is historical compensation characteristic values P2 that are obtained in a previous display cycle of the screen.

Figure 1:
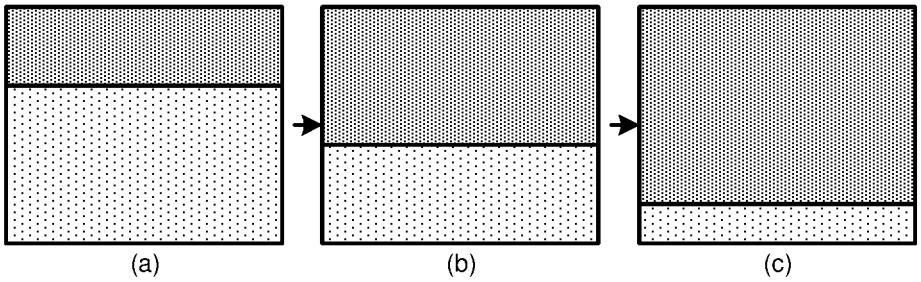
FIG. 1 is a schematic diagram showing a phenomenon of uneven brightness and a refreshing phenomenon of a display apparatus during pixel compensation, in accordance with some embodiments.

In some embodiments of the present disclosure, referring to part (a) in FIG. 1 and FIG. 2, in a time period from a first blanking time to a jth blanking time in the present display cycle of the screen, all pixels from the first row of pixels Pixel1 to an mth row of pixels Pixelm in FIG. 2 are already scanned ($j \leq m$, and $m<N$), and present characteristic values P1 of the driving transistors of all pixels from the first row of pixels Pixel1 to the mth row of pixels Pixelm are obtained. In this case, the obtained present characteristic values P1 of the driving transistors of all pixels from the first row of pixels Pixel1 to the mth row of pixels Pixelm are directly used as compensation data, i.e. present compensation characteristic values P, for the driving transistors of all pixels from the first row of pixels Pixel1 to the mth row of pixels Pixelm.

Then, after the jth blanking time is over, the display period of the next frame of image begins, and the present characteristic values P1 of the driving transistors of the pixels from the first row of pixels Pixel1 to the mth row of pixels Pixelm obtained in the first blanking time to the jth blanking time in the present display cycle of the screen are used to compensate the pixels from the first row of pixels Pixel1 to the mth row of pixels Pixelm. However, when compensating pixels from an (m+1)th row of pixels Pixel (m+1) to the Nth row of pixels PixelN, compensation data used is historical compensation characteristic values P2 obtained in a previous display cycle of the screen.

In this case, there may be a large difference between the present compensation characteristic values P of the driving transistors of pixels from the first row of pixels to the mth row of pixels obtained in the present display cycle of the screen (i.e., the present characteristic values P1) and the historical compensation characteristic values P2 of the driving transistors of pixels from the (m+1)th row of pixels to the Nth row of pixels obtained in the previous display cycle of the screen, and an image displayed by the display apparatus in the next frame of image may be as shown in part (a) of FIG. 1 with a layering problem.

Moreover, as the scanning progresses gradually from the (m+1)th row of pixels to the Nth row of pixels, the screen of the display apparatus may be gradually refreshed from the situation shown in part (a) of FIG. 1 to the situation shown in prat (b) of FIG. 1, and then gradually refreshed to the situation shown in part (c) of FIG. 1. That is to say, there may be a refreshing problem on the screen of the display apparatus during display periods of different frames of images.

In view of the above problems, some embodiments of the present disclosure provide the following implementation 2 for S100 above.

Implementation 2

Referring to FIG. 3, the step S100 of obtaining the present compensation characteristic values P of the driving transistors of the pixels may include the following steps.

In S10, driving transistors of pixels are detected in the present display cycle of the screen to obtain present characteristic values P1 of the driving transistors of the pixels.

This operation of scanning pixels from the first row of pixels to a last row of pixels in a plurality of blanking times for obtaining the present characteristic values P1 is referred to as scanning of a display cycle of the screen.

The present characteristic values P1 of the driving transistors of the pixels are obtained in any one of the same manner as in the Implementation 1 described above.

In S20, historical compensation characteristic values P2 of the driving transistors of the pixels obtained in a previous display cycle of the screen are extracted.

In S30, present compensation characteristic values P of the driving transistors of the pixels are calculated according to the present characteristic values P1 and the historical compensation characteristic values P2 of the driving transistors of the pixels.

After all the steps S10-S30 of the above step S100 are performed, step S40 may be further performed to compensate corresponding pixels according to the present compensation characteristic values P of the driving transistors of the pixels. S40 herein is the same as the step S200 above.

The present compensation characteristic values P are calculated according to the present characteristic values P1 and the historical compensation characteristic values P2 of the driving transistors. This is to say, both the present characteristic values P1 and the historical compensation characteristic values P2 are taken into consideration when obtaining the present compensation characteristic values P. Therefore, a difference between the present compensation characteristic value P and a corresponding historical compensation characteristic value P2 is reduced. As a result, a difference between a portion of the screen in which the present compensation characteristic values P are used to compensate corresponding pixels and a portion of the screen in which the historical compensation characteristic values P2 are used to compensate corresponding pixels is reduced.

For example, a difference between a brightness of the portion of the screen in which the present compensation characteristic values P are used to compensate corresponding pixels and a brightness of the portion of the screen in which the historical compensation characteristic values P2 are used to compensate corresponding pixels is reduced, thereby improving the viewer's viewing experience.

There are various ways to obtain the present compensation characteristic values P of the driving transistors of the pixels. A detailed description is given below by taking an example in which a plurality of pixels in a display apparatus are arranged in a way as shown in FIG. 2. That is, the plurality of pixels in the display apparatus are arranged in an array, and the plurality of pixels are divided into N rows.

Illustratively, there is a single blanking time in a display period of each frame of image, and in one blanking time, a single row of pixels can be scanned and the driving transistors of the scanned row of pixels can be detected. In this case, an operation of scanning all the N rows of pixels is scanning of a display cycle of the screen, and N frames of images are displayed in each display cycle of the screen. In a case where the display apparatus has 2160 rows of pixels and the refresh frequency is 60 Hz, a time taken to complete the scanning of a single display cycle of the screen is 2160/60=36 seconds.

Referring to FIG. 2, in a display scanning time of a first frame of image in the present display cycle of the screen, the pixels are scanned from the first row of pixels to the Nth row of pixels, so that the pixels of each row are sequentially made to emit light, thereby realizing display of the first frame of image. Therefore, when the display apparatus displays the first frame of image, compensation data used for compensating the pixels is the history compensation characteristic values P2 of the driving transistors of the pixels obtained in a previous display cycle of the screen.

After a display scanning time of the first frame of image of the present display cycle of the screen is over, a first blanking time of the present display cycle of the screen begins. At this time, the first row of pixels Pixel1 are scanned, and driving transistors of all pixels in the first row of pixels Pixel1 are detected to obtain present characteristic values P1 of all pixels in the first row of pixels Pixel1. Then, historical compensation characteristic values P2 of the driving transistors of all pixels in the first row of pixels Pixel1 obtained in the previous display cycle of the screen are extracted. After that, present compensation characteristic values P of the driving transistors of all pixels in the first row of pixels Pixel1 are calculated according to the present characteristic values P1 and the historical compensation characteristic values P2.

After the first blanking time of the present display cycle of the screen is over, a display scanning time of a second frame of image in the present display cycle of the screen begins. In the display scanning time of the second frame of image, when the display apparatus displays the second frame of image, compensation data used for compensating all pixels in the first row of pixels Pixel1 is present compensation characteristic values P of the driving transistors of all pixels in the first row of pixels Pixel1 obtained in the present display cycle of the screen. However, compensation data used for compensating pixels from a second row of pixels Pixel2 to the Nth row of pixels PixelN are historical compensation characteristic values P2 of driving transistors of the pixels from the second row of pixels Pixel2 to the Nth row of pixels PixelN obtained in the previous display cycle of the screen.

After the display scanning time of the second frame of image of the present display cycle of the screen is over, a second blanking time of the present display cycle of the screen begins. At this time, the second row of pixels Pixel2 are scanned, and driving transistors of all pixels in the second row of pixels Pixel2 are detected to obtain present characteristic values P1 of all pixels in the second row of pixels Pixel2. Then, historical compensation characteristic values P2 of the driving transistors of all pixels in the second row of pixels Pixel2 obtained in the previous display cycle of the screen are extracted. After that, present compensation characteristic values P of the driving transistors of all pixels in the second row of pixels Pixel2 are calculated according to the present characteristic values P1 and the historical compensation characteristic values P2.

In this way, in multiple blanking times, all pixels from the first row of pixels Pixel1 to the Nth row of pixels PixelN are sequentially scanned and the driving transistors of the pixels are detected to obtain present characteristic values P1 of the driving transistors of the pixels. Then the present compensation characteristic values P of the driving transistors of the pixels are calculated according to the present characteristic values P1 of the driving transistors of the pixels and the historical compensation characteristic values P2 of the driving transistors of the pixels obtained in the previous display cycle of the screen.

In some embodiments of the present disclosure, in a single blanking time, multiple rows of pixels may be sequentially scanned, and driving transistors of the scanned multiple rows of pixels may be detected. A way in which the multiple rows of pixels are scanned and driving transistors of the scanned multiple rows of pixels are detected is similar to a way in which a single row of pixels are scanned and driving transistors of the scanned single row of pixels are detected in a single blanking time, which will not be described herein again.

That is to say, in a single blanking time, a single row of pixels are scanned or multiple rows of pixels are sequentially scanned, and the driving transistors of the scanned single row of pixels or the scanned multiple rows of pixels are detected, so as to obtain present characteristic values P1 of the driving transistors of the single row of pixels or the multiple rows of pixels. In addition, historical compensation characteristic values P2 corresponding to the driving transistors of the single row of pixels or the multiple rows of pixels obtained in the previous display cycle of the screen are extracted, and present compensation characteristic values P of the driving transistors of the single row of pixels or the multiple rows of pixels are calculated according to the present characteristic values P1 and the historical compensation characteristic values P2.

In some embodiments of the present disclosure, a manner in which the present compensation characteristic values P of the driving transistors of the pixels are obtained may be as follows. In each blanking time, when scanning a single row of pixels or sequentially scanning multiple rows of pixels, only driving transistors of pixels having a same color in the single row of pixels or the multiple rows of pixels are detected, so as to obtain present characteristic values P1 of the driving transistors of the pixels having the same color in the single row of pixels or the multiple rows of pixels, so that the present compensation characteristic values P are calculated.

Illustratively, in a single blanking time, one row of pixels can be scanned, and driving transistors of pixels having a same color in the one row of pixels are detected. Referring to FIG. 2, the display apparatus adopts an RGB color mode.

Among each row of pixels, one third of the pixels are R pixels 1, one third of the pixels are G pixels 2, and one third of the pixels are B pixels 3. Pixels in each row are arranged sequentially and repeatedly in an order of R pixel 1, G pixel 2, and B pixel 3. For example, present compensation characteristic values P of driving transistors of the R pixels 1 are obtained first, present compensation characteristic values P of driving transistors of the G pixels 2 are obtained next, and present compensation characteristic values P of driving transistors of the B pixels 3 are obtained at last.

In the display scanning time of the first frame of image in the present display cycle of the screen, when the display apparatus displays the first frame of image, compensation data used for compensating the pixels is the historical compensation characteristic values P2 of the driving transistors of the pixels obtained in the previous display cycle of the screen.

After the display scanning time of the first frame of image of the present display cycle of the screen is over, the first blanking time of the present display cycle of the screen begins. At this time, the first row of pixels Pixel1 are scanned, and driving transistors of all R pixels 1 in the first row of pixels Pixel1 are detected to obtain present characteristic values P1 of all R pixels 1 in the first row of pixels Pixel1 . Then, historical compensation characteristic values P2 of the driving transistors of all R pixels 1 in the first row of pixels Pixel1 obtained in a previous display cycle of the screen are extracted. After that, present compensation characteristic values P of the driving transistors of all R pixels 1 in the first row of pixels Pixel1 are calculated according to the present characteristic values P1 and the historical compensation characteristic values P2.

After the first blanking time of the present display cycle of the screen is over, the display scanning time of the second frame of image of the present display cycle of the screen begins. In the display scanning time of the second frame of image, when the display apparatus displays the second frame of image, compensation data used for compensating all R pixels 1 in the first row of pixels Pixel1 are present compensation characteristic values P of the driving transistors of all R pixels 1 in the first row of pixels Pixel1 obtained in the present display cycle of the screen. Compensation data used for compensating all other pixels except for the R pixels 1 in the first row of pixels Pixel1 are corresponding historical compensation characteristic values P2 obtained in the previous display cycle of the screen, and compensation data used for compensating all pixels from the second row of pixels Pixel2 to the Nth row of pixels PixelN are historical compensation characteristic values P2 of driving transistors of all the pixels from the second row of pixels Pixel2 to the Nth row of pixels PixelN obtained in the previous display cycle of the screen.

After the display scanning time of the second frame of image of the present display cycle of the screen is over, the second blanking time of the present display cycle of the screen begins. At this time, the second row of pixels Pixel2 are scanned, and driving transistors of all R pixels 1 in the second row of pixels Pixel2 are detected to obtain present characteristic values P1 of the driving transistors of all R pixels 1 in the second row of pixels Pixel2. Then, historical compensation characteristic values P2 of the driving transistors of all R pixels 1 in the second row of pixels Pixel2 obtained in the previous display cycle of the screen are extracted. After that, present compensation characteristic values P of the driving transistors of all R pixels 1 in the second row of pixels Pixel2 are calculated according to the present characteristic values P1 and the historical compensation characteristic values P2.

In this way, all pixels from the first row of pixels Pixel1 to the Nth row of pixels PixelN are sequentially scanned, and the driving transistors of all R pixels 1 in the rows of pixels are detected, so as to obtain present characteristic values P1 of the driving transistors of all R pixels 1. The present compensation characteristic values P of the driving transistors of all R pixels 1 are calculated according to the present characteristic values P1 of the driving transistors of all R pixels 1 and the historical compensation characteristic values P2 of the driving transistors of all R pixels 1 obtained in the previous display cycle of the screen.

After the present compensation characteristic values P of all R pixels 1 are obtained, all pixels from the first row of pixels Pixel1 to the Nth row of pixels PixelN are sequentially scanned to detect driving transistors of all G pixels 2, so as to obtain present characteristic values P1 of the driving transistors of all G pixels 2, and present compensation characteristic values P of the driving transistors of all G pixels 2 are calculated according to the present characteristic values P1 of the driving transistors of all G pixels 2 and historical compensation characteristic values P2 of the driving transistors of all G pixels 2 obtained in the previous display cycle of the screen.

After the present compensation characteristic values P of all G pixels 2 are obtained, all pixels from the first row of pixels Pixel1 to the Nth row of pixels PixelN are sequentially scanned to detect driving transistors of all B pixels 3, so as to obtain present characteristic values P1 of the driving transistors of all B pixels 3, and present compensation characteristic values P of the driving transistors of all B pixels 3 are calculated according to the present characteristic values P1 of the driving transistors of all B pixels 3 and historical compensation characteristic values P2 of the driving transistors of all B pixels 3 obtained in the previous display cycle of the screen.

Alternatively, the R pixels 1 in the first row of pixels Pixel1 are scanned first, and the driving transistors of all the R pixels 1 in the first row of pixels Pixel1 are detected, so as to obtain present characteristic values P1 and calculate present compensation characteristic values P. Then, the G pixels 2 in the first row of pixels Pixel1 are scanned, and the driving transistors of all the G pixels 2 in the first row of pixels Pixel1 are detected, so as to obtain present characteristic values P1 and calculate present compensation characteristic values P. After that, the B pixels 3 in the first row of pixels Pixel1 are scanned, and the driving transistors of all the B pixels 3 in the first row of pixels Pixel1 are detected, so as to obtain present characteristic values P1 and calculate present compensation characteristic values P. After scanning of the R pixels 1, G pixels 2, and B pixels 3 in the first row of pixels Pixel1 is completed, scanning of the R pixels 1, G pixels 2, and B pixels 3 in the second row of pixels Pixel2 is performed. And the rest may be deduced by analogy, until scanning of the R pixels 1, G pixels 2, and B pixels 3 in a last row of pixels is completed.

In a single blanking time, multiple rows of pixels may be sequentially scanned, and driving transistors of pixels having the same color in the scanned multiple rows of pixels may be detected. A way in which the multiple rows of pixels are scanned and driving transistors of pixels having the same color in the scanned multiple rows of pixels are detected in a single blanking time is similar to a way in which a single row of pixels are scanned and driving transistors of pixels having the same color in the scanned single row of pixels are detected in a single blanking time, which will not be described herein again.

In the above Implementation 2, both the present characteristic values P1 and the historical compensation characteristic values P2 are taken into consideration when obtaining the present compensation characteristic values P. As a result, each obtained present compensation characteristic value P is between a corresponding present characteristic value P1 and a corresponding historical compensation characteristic value P2. Therefore, the difference between the present compensation characteristic value P and the historical compensation characteristic value P2 may be reduced, and the layering and refreshing problems in the images displayed by the display apparatus may be avoided.

Some examples of implementing the pixel compensation method shown in FIG. 3 are provided below. In these examples, when calculating the present compensation characteristic values P of the driving transistors of the pixels according to the present characteristic values P1 and the historical compensation characteristic values P2 of the driving transistors of the pixels, in order to reduce the difference between the portion of the screen in which the present compensation characteristic values P are used to compensate corresponding pixels and the portion of the screen in which the historical compensation characteristic values P2 are used to compensate corresponding pixels, a step value Kstep may be obtained in advance, and the present compensation characteristic values P may be obtained through calculation among P1, P2 and Kstep, so that the present compensation characteristic value P is between P1 and P2. In this way, the difference between the portions of the screen may be reduced, and the viewer's viewing experience may be improved.

Figure 4:
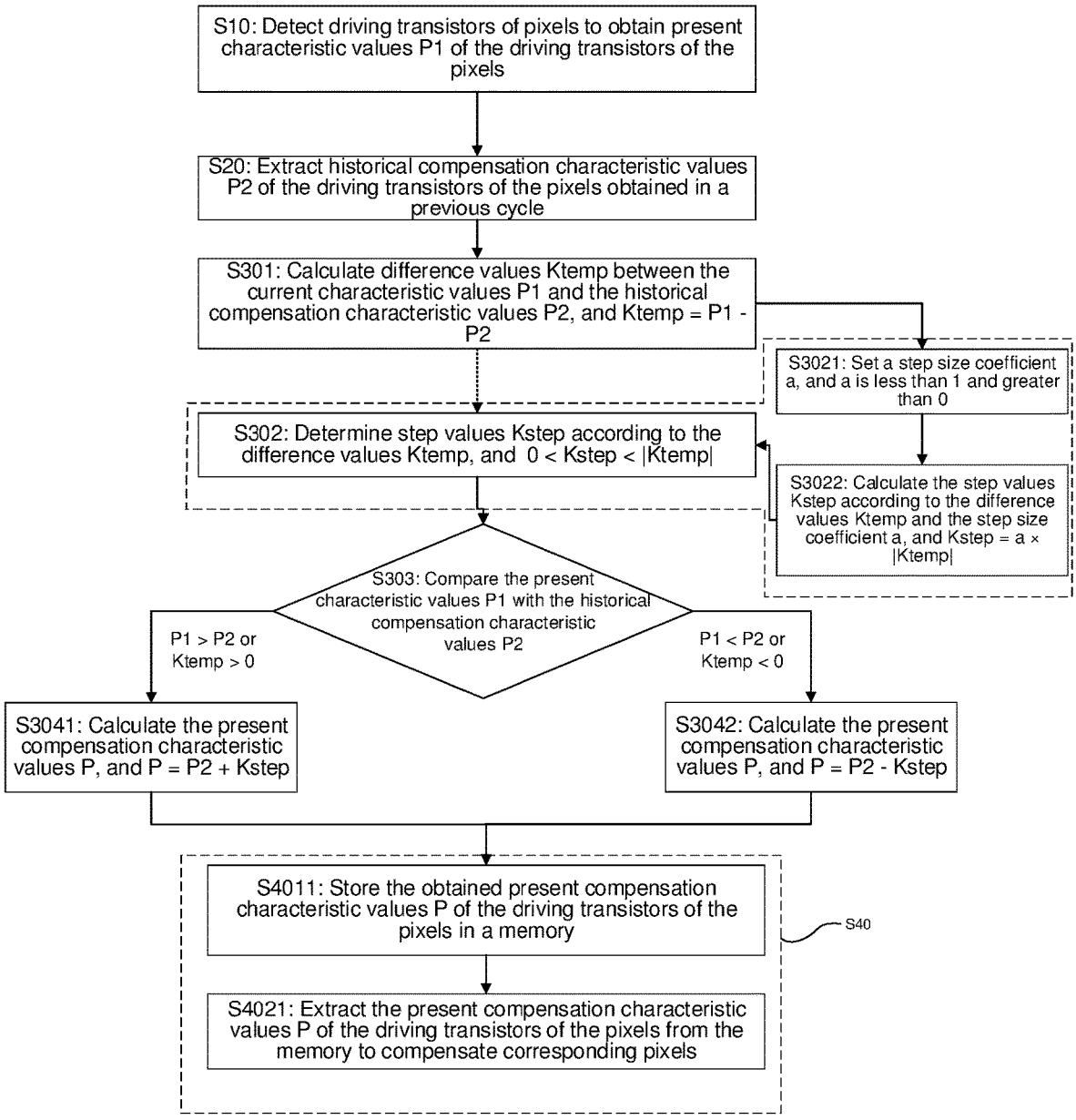
FIG. 4 is an exemplary flow diagram of the pixel compensation method shown in FIG. 3.

As shown in FIG. 4, some embodiments of the present disclosure provide a pixel compensation method, which includes the following steps.

In S10, driving transistors of pixels are detected to obtain present characteristic values P1 of the driving transistors of the pixels.

In S20, historical compensation characteristic values P2 of the driving transistors of the pixels obtained in a previous display cycle of the screen are extracted.

In S301, a difference value Ktemp between each present characteristic value P1 and a corresponding historical compensation characteristic value P2 is calculated, and Ktemp is a difference between P1 and P2 (Ktemp=P1−P2).

In S302, a step value Kstep is determined according to the difference value Ktemp. Kstep is greater than 0 and less than an absolute value of Ktemp ($0<Kstep<|Ktemp|$).

It may also be understood this way: the step value Kstep is greater than or equal to 0, and the step value Kstep is less than the absolute value of the difference value Ktemp.

It will be noted that when the present characteristic value P1 of the driving transistor is the threshold voltage of the driving transistor, the above process is applied to the threshold voltage to obtain the present compensation threshold voltage. In the case where the present characteristic value P1 of the driving transistor includes the threshold voltage of the driving transistor and the first detection value, the above calculation is applied to both the threshold voltage and the first detection value, to obtain the present compensation threshold voltage and the present compensation first detection value.

A process of calculating the step value Kstep includes the following steps.

In S3021, a step size coefficient a is set, and a is less than 1 and greater than 0.

In S3022, the step value Kstep is calculated according to the difference value Ktemp and the step size coefficient a, and Kstep is a product of a and the absolute value of Ktemp ($Kstep=a\times|Ktemp|$).

First, the step size coefficient a is set, and a is a decimal less than 1 and greater than 0, that is, $0<a<1$. The step size coefficient a may be set according to actual needs. For example, the step coefficient a can be set to a fixed value, and when calculating a present compensation characteristic value P of a driving transistor of each pixel in the display apparatus, a same step size coefficient a is used. Alternatively, when calculating present compensation characteristic values P of driving transistors of different pixels in the display apparatus, different step size coefficients a are used.

Illustratively, the display apparatus shown in FIG. 2 adopts the RGB color mode. Among the plurality of pixels of the display apparatus, one third of the pixels are R pixels 1, one third of the pixels are G pixels 2, and one third of the pixels are B pixels 3. A step size coefficient a used for calculating the present compensation characteristic values P of the driving transistors of the R pixels 1 in the display apparatus, a step size coefficient a used for calculating the present compensation characteristic values P of the driving transistors of the G pixels 2 in the display apparatus, and a step size coefficient a used for calculating the present compensation characteristic values P of the driving transistors of the B pixels 3 in the display apparatus are all different.

Alternatively, illustratively, the display apparatus shown in FIG. 11 adopts an RGBW (red, green, blue, and white) color mode. Among the plurality of pixels of the display apparatus, one quarter of the pixels are R pixels 1, one quarter of the pixels are G pixels 2, one quarter of the pixels are B pixels 3, and one quarter of the pixels are W pixels 4. A step size coefficient a used for calculating the present compensation characteristic values P of the driving transistors of the R pixels 1 in the display apparatus, a step size coefficient a used for calculating the present compensation characteristic values P of the driving transistors of the G pixels 2 in the display apparatus, a step size coefficient a used for calculating the present compensation characteristic values P of the driving transistors of the B pixels 3 in the display apparatus, and a step size coefficient a used for calculating present compensation characteristic values P of driving transistors of the W pixels 4 are all different.

Alternatively, multiple difference value ranges corresponding to the Ktemp may be set, and for each difference value range, a corresponding step size coefficient a may be set. In a case where a difference value Ktemp falls into a certain difference value range, a corresponding step size coefficient a may be determined. In a case where a step value Kstep is to be determined, the step value Kstep may be calculated according to the difference value Ktemp and the step size coefficient a. That is, Kstep is a product of the step size coefficient a and the absolute value of the difference value Ktemp ($Kstep=a\times|Ktemp|$). In this way, it may be possible to make the step value Kstep less than the absolute value of the difference value Ktemp, so that the calculated present compensation characteristic value P is between the present characteristic value P1 and the historical compensation characteristic value P2.

The above method of setting the step size coefficient a is only an example. In practical applications, the step size coefficient a may be set according to different states of the driving transistors of the pixels during use, as long as the step size coefficient a is within a range from 0 and 1 (i.e., a is greater than 0 and less than 1), and the embodiments of present disclosure is not limited thereto.

In S303, the present characteristic value P1 and the historical compensation characteristic value P2 are compared.

The present characteristic value P1 and the historical compensation characteristic value P2 may be directly compared to determine which of the present characteristic value P1 and the historical compensation characteristic value P2 is greater. Alternatively, it may be determined whether the difference value Ktemp between the present characteristic value P1 and the historical compensation characteristic value P2 is positive or negative. In a case where the difference value Ktemp is positive, it means that the present characteristic value P1 is greater than the historical compensation characteristic value P2. In a case where the difference Ktemp is negative, it means that the present characteristic value P1 is less than the historical compensation characteristic value P2.

In a case where the present characteristic value P1 is greater than the historical compensation characteristic value P2, S3041 is performed; in a case where the present characteristic value P1 is less than the historical compensation characteristic value P2, S3042 is performed.

In S3041, a present compensation characteristic value P is calculated, and P is a sum of the historical compensation characteristic value P2 and the step value Kstep (P=P2+Kstep).

In S3042, a present compensation characteristic value P is calculated, and P is a difference between the historical compensation characteristic value P2 and the step value Kstep (P=P2−Kstep).

When calculating the present compensation characteristic value P, a step value Kstep is added to or subtracted from the historical compensation characteristic value P2. Since the step value Kstep is greater than or equal to 0, and less than the absolute value of the difference value Ktemp that is between the present characteristic value P1 and the historical compensation characteristic value P2, the calculated present compensation characteristic value P will be between the present characteristic value P1 and the historical compensation characteristic value P2. As a result, while achieving compensation for the pixels, it is possible to reduce the difference between the portion of the screen of the display apparatus in which the present compensation characteristic values P are used to compensate corresponding pixels and the portion of the screen of the display apparatus in which the historical compensation characteristic values P2 are used to compensate corresponding pixels, and thus improve the viewer's viewing experience.

In S4011, obtained present compensation characteristic values P of the driving transistors of the pixels are stored in a memory.

In a blanking time between display scanning times of two adjacent frames of images, a single row or multiple rows of pixels in the N rows of pixels of the display apparatus are scanned, and driving transistors of the pixels scanned are detected, so as to calculate the present compensation characteristic values P of the driving transistors of the pixels scanned in the blanking time. The present compensation characteristic values P of the driving transistors of the pixels obtained in the blanking time overrides the previously obtained historical compensation characteristic values P2 corresponding to the driving transistors of the pixels scanned, and are stored in the memory.

In S4021, the present compensation characteristic values P of the driving transistors of the pixels are extracted from the memory to compensate corresponding pixels.

After the above blanking time is over, a display scanning time of a next frame of image begins. In the display scanning time of the next frame of image, the present compensation characteristic values P of the driving transistors of the pixels scanned in the above blanking time are extracted from the memory to compensate corresponding pixels. In this case, historical compensation characteristic values P of driving transistors of remaining pixels that are obtained before the above blanking time and that are not scanned in the above blanking time are extracted from the memory to compensate corresponding remaining pixels.

It will be noted that, in the above compensation process, there are other alternatives for S10 to S3042. For example, the present characteristic values P1 of the driving transistors of the pixels may be directly used as the present compensation characteristic values P to compensate corresponding pixels, which is not limited herein.

In some embodiments, the step of compensating corresponding pixel according to the present compensation characteristic values P of the transistors of the pixels, includes: compensating the data voltages to be applied to the pixel circuits according to the present compensation first detection values and the present compensation threshold voltages.

For example, the data voltage (indicated by $V_{data}$) to be applied to the pixel circuit is divided by a first parameter, and then a second parameter is added into the result to obtain the data voltage compensated. The first parameter is the quotient of the square root of the present compensation first detection value (indicated by $V_{sl}$) divided by a first preset value equal to $k\sqrt{b}$. The second parameter is the sum of the threshold voltage of the driving transistor (indicated by $V_{th}$) and a second preset value equal to 0 (here, setting the second preset value to zero, i.e., assuming that the value of the threshold voltage is accurate and is not corrected, may reduce an overall calculation). Where k is a pre-calibrated parameter, b is a proportional coefficient satisfying a formula, i.e., $L_U=bV_{data}^2$, $L_U$ is a luminance corresponding to $V_{data}$, and refers to a luminance desired when a value is selected for $V_{data}$, or a target value of the luminance. Thereby, based on $V_{s1}$ and $V_{th}$ obtained and in combination with preset k and b, the data voltage compensated may be obtained based on $V_{data}$, and a process of any data compensation is achieved.

In another example, the step of compensating the data voltage to be applied to the pixel circuit according to the present compensation first detection value and the present compensation threshold voltage may include: calculating a square root of a quotient obtained by dividing a target value of the luminance (i.e., the above Lu) corresponding to the data voltage to be applied to the pixel circuit (i.e., the above $V_{data}$) by the first detection value (i.e., the above $V_{s1}$), multiplying the square root obtained by the pre-calibrated parameter (i.e., the above k) and adding the threshold voltage of the driving transistor (i.e., the above $V_{th}$) to obtain a compensated data voltage.

The above Lu may be calculated through $V_{data}$ and b according to the formula $L_U=bV^2_{data}$, and may also be calculated through a formula $L_U=f(GL_{in})$, wherein $GL_{in}$ is a gray scale value in an image signal or a video signal corresponding to an original data voltage, and f is a function of converting the gray scale value into a luminance value, which is determined by a gamma curve (a luminance coefficient curve) to be achieved by display. That is, the function f will vary with the gamma curve. As can be seen from this example, any of the above data compensation methods does not necessarily include a process of obtaining the original data voltage.

As an example of calibrating the above parameter k, a sample of the display apparatus when it is delivered may be tested according to the calculation method of the compensated data voltage $V_{cp}$ described above, and the pre-calibrated parameter k is calculated according to $V_{cp}$, $V_{si}$ and L when a target compensation effect is obtained and in combination with $V_{th}$ actually measured. Of course, a value used in the calibration may be selected between a measured value and a theoretical value, and is not limited to the above example.

It will be noted that, the above k is applied to all the pixel circuits emitting the light of the same color of the display apparatus after being determined, and may be adjusted as needed during use of the display apparatus. In addition, parameters that are applied to all the pixel circuits emitting the light of the same color of the display apparatus and may be adjusted as needed further include at least one of the first preset time, the first preset voltage, the second preset voltage, the first preset value and the second preset value described above.

In the above compensation process, there are other alternatives for S4011 and S4021, which will be described in detail below.

Several variations of the embodiments of the pixel compensation method shown in FIG. 4 will be described below.

Variation 1

Figure 5:
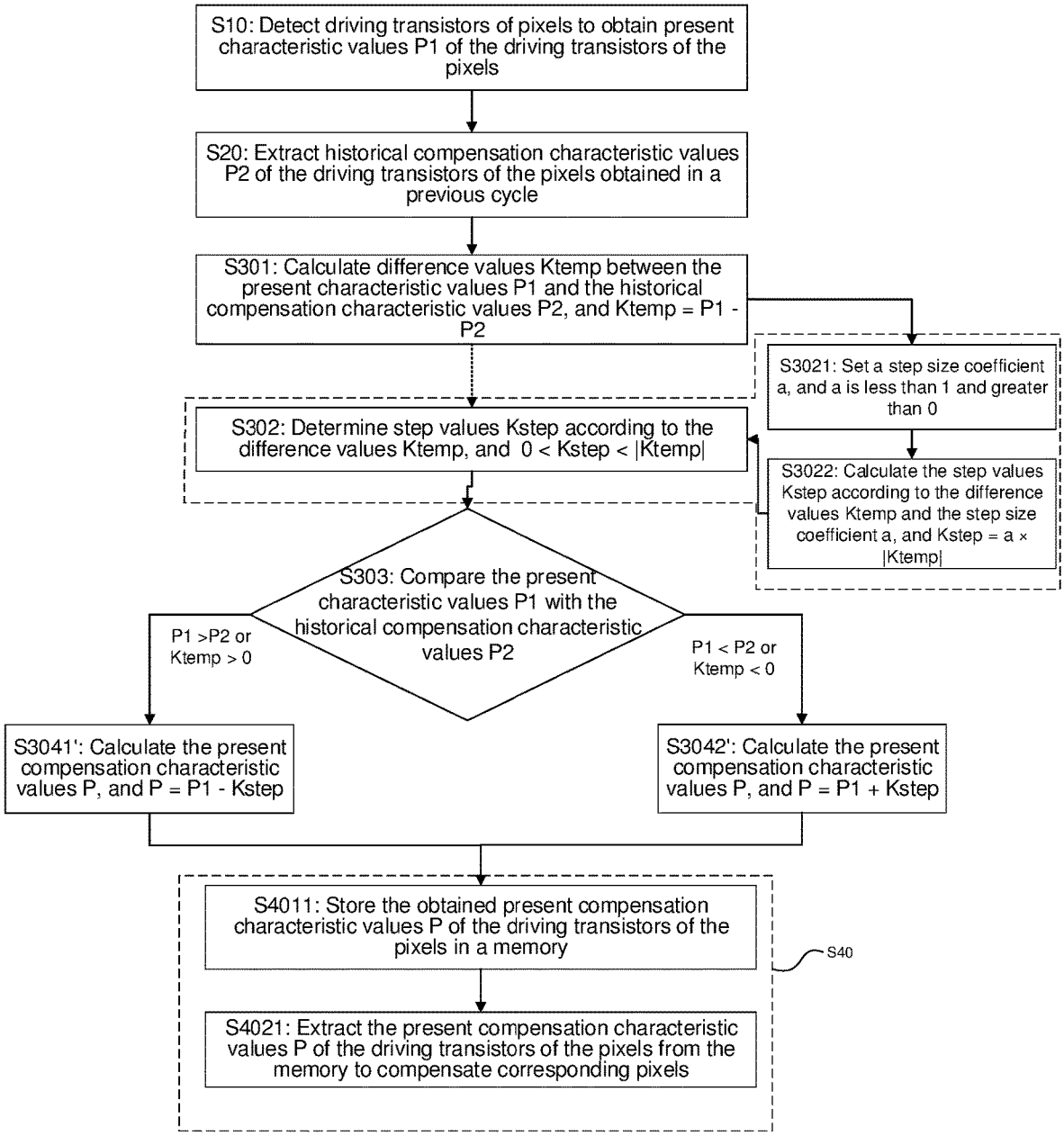
FIG. 5 is a flow diagram of a first variation of the pixel compensation method shown in FIG. 4, in accordance with some embodiments.

In some embodiments of the present disclosure, a step value Kstep may also be added to or subtracted from the present characteristic value P1. Referring to FIG. 5, S10-S303, S4011, and S4021 are the same as the S10-S303, S4011, and S4021 shown in FIG. 4 respectively. In order to avoid unnecessary repetitions in description of the pixel compensation method shown in FIG. 5, details are not described herein again. Differences between the two methods will be described in detail below, and description of the same parts of the two methods will be omitted. The same-numbered steps in FIG. 5 represent the same steps as those shown in FIG. 4.

In comparison results of S303, in the case where the present characteristic value P1 is greater than the historical compensation characteristic value P2, S3041' is performed; in the case where the present characteristic value P1 is less than the historical compensation characteristic value P2, S3042' is performed.

In S3041', a present compensation characteristic value P is calculated, and P is a difference between the present characteristic value P1 and the step value Kstep (P=P1−Kstep).

In S3042', a present compensation characteristic value P is calculated, and P is a sum of the present characteristic value P1 and the step value Kstep (P=P1+Kstep).

When calculating the present compensation characteristic value P, a step value Kstep is added to or subtracted from the present characteristic value P1. Since the step value Kstep is greater than or equal to 0, and less than the absolute value of the difference value Ktemp that is between the present characteristic value P1 and the historical compensation characteristic value P2, the calculated present compensation characteristic value P will be between the present characteristic value P1 and the historical compensation characteristic value P2. As a result, while achieving compensation of the pixels, it is possible to reduce the difference between the portion of the screen of the display apparatus in which the present compensation characteristic values P are used to compensate corresponding pixels and the portion of the screen of the display apparatus in which the historical compensation characteristic values P2 are used to compensate corresponding pixels, and thus improve the viewer's viewing experience.

Variation 2

Figure 6:
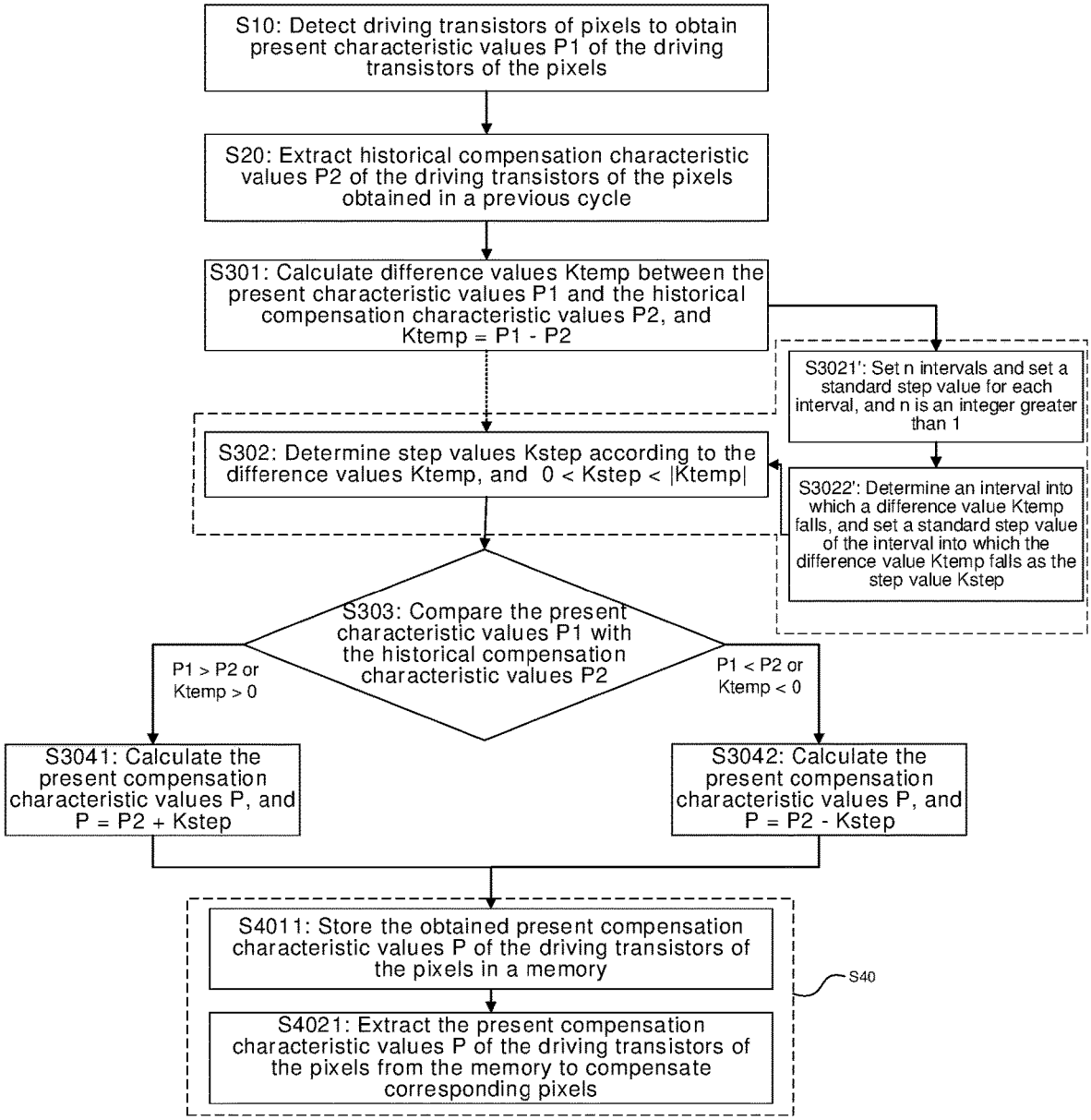
FIG. 6 is a flow diagram of a second variation of the pixel compensation method shown in FIG. 4, in accordance with some embodiments.

In some embodiments of the present disclosure, as shown in FIG. 6, in the step S302 of determining the step value Kstep according to the difference value Ktemp, except for the approach shown in FIG. 4, there are still many other ways to determine the step value Kstep. The following is an example of another way to determine the step value Kstep. It will be noted that, a manner in which the step value Kstep is determined includes, but is not limited to, the two methods shown in FIGS. 4 and 6.

In FIG. 6, except for the step of determining the step value Kstep, as stated above, other steps are all the same as those in the pixel compensation method shown in FIG. 4. In order to avoid unnecessary repetitions in description of embodiments of the present disclosure, details are not described herein again. Differences between the two methods will be described in detail below, and description of the same parts of the two methods will be omitted. Referring to FIG. 6, the same-numbered steps in FIG. 6 represent the same steps as those shown in FIG. 4.

In S3021', n intervals are set, and a standard step value is set for each interval; and n is an integer greater than 1.

In some embodiments of the present disclosure, the n intervals may be set according to actual needs. For example, the n intervals may be continuous intervals. That is, a value of a starting endpoint of an ith interval is equal to a value of an ending endpoint of an (i−1)th interval. In a case where the (i−1)th interval is open at the ending endpoint of the (i−1)th interval, the i-th interval is closed at the starting endpoint of the i-th interval, and in a case where the (i−1)th interval is closed at the ending endpoint of the (i−1)th interval, the i-th interval is open at the starting endpoint of the i-th interval, where i is greater than or equal to 2 and less than or equal to n (2≤i≤n).

That is to say, the n intervals may be: [Temp1, Temp2), [Temp2, Temp3), [Temp3, Temp4), . . . , [Temp i−1, Temp i), [Tempi, Temp(i+1)) , . . . , [Temp(n−1), Tempn), [Tempn, Temp(n+1)], and the value is increased gradually from Temp1 to Temp(n+1). In this case, the ending endpoint of the (i−1)th interval is Tempi, and the (i−1)th interval is open at the ending endpoint of the (i−1)th interval. The starting endpoint of the ith interval is Tempi, and the ith interval is closed at the starting endpoint of the ith interval.

It will be noted that, in this case, an nth interval is closed at an ending endpoint of the nth interval, so as to avoid a situation in which a step value Kstep cannot be determined in a case where the difference value Ktemp is equal to a value of the ending endpoint of the nth interval.

Alternatively, the n intervals may be: [Temp1, Temp2], (Temp2, Temp3], (Temp3, Temp4], . . . , (Temp(i−1), Tempi], (Tempi, Temp(i+1)], . . . , (Temp(n−1), Tempn], (Tempn, Temp(n+1)], and the value is increased gradully from Temp1 to Temp(n+1). In this case, the ending endpoint of the (i−1)th interval is Tempi, and the (i−1)th interval is closed at the ending endpoint of the (i−1)th interval. The starting endpoint of the ith interval is Tempi, and the ith interval is open at the starting endpoint of the ith interval. It will be noted that, in this case, a first interval is closed at a starting endpoint of the first interval, so as to avoid a situation in which a step value Kstep cannot be determined in a case where the difference value Ktemp is equal to a value of the starting endpoint of the first interval.

When setting the n intervals, the starting endpoint of the first interval and the ending endpoint of the nth interval may be set according to actual needs. For example, the value of the starting endpoint of the first interval may be set to 0, the value of the ending endpoint of the nth interval may be greater than 0, and among the n intervals, the ending endpoint of each interval will be greater than 0. In this case, when determining an interval into which the difference value Ktemp falls in a subsequent step, an interval into which the absolute value of the difference value Ktemp falls is required to be determined. Alternatively, the value of the starting endpoint of the first interval is less than 0, and the value of the ending endpoint of the nth interval is greater than 0.

In S3022', an interval into which the difference value Ktemp falls is determined, and a standard step value of the interval into which the difference value Ktemp falls is set as the step value Kstep.

In some embodiments of the present disclosure, when setting the n intervals, a standard step value is set for each of the n intervals according to actual needs. For example, a standard step value corresponding to the ith interval is Ti; Ti is less than T(i+1)(Ti<T(i+1)), and i is greater than or equal to 1 and less than or equal to a difference between n and 1 ($1 \le i \le n-1$). For example, in a case where the starting endpoint of the first interval in the n intervals is set to 0, the ending endpoint of the nth interval is greater than 0, and the ending endpoint of each of the n intervals is greater than 0, the starting endpoint of each interval may be used as the standard step value corresponding to the interval. That is, the standard step value corresponding to the ith interval is equal to the starting endpoint of the ith interval.

When determining the step value Kstep, the difference value Ktemp may be compared with the n intervals, and an interval into which the difference value Ktemp falls is determined. After the interval into which the difference value Ktemp falls is determined, a standard step value corresponding to the interval into which the difference value Ktemp falls may be determined as the step value Kstep.

Variation 3

Figure 7:
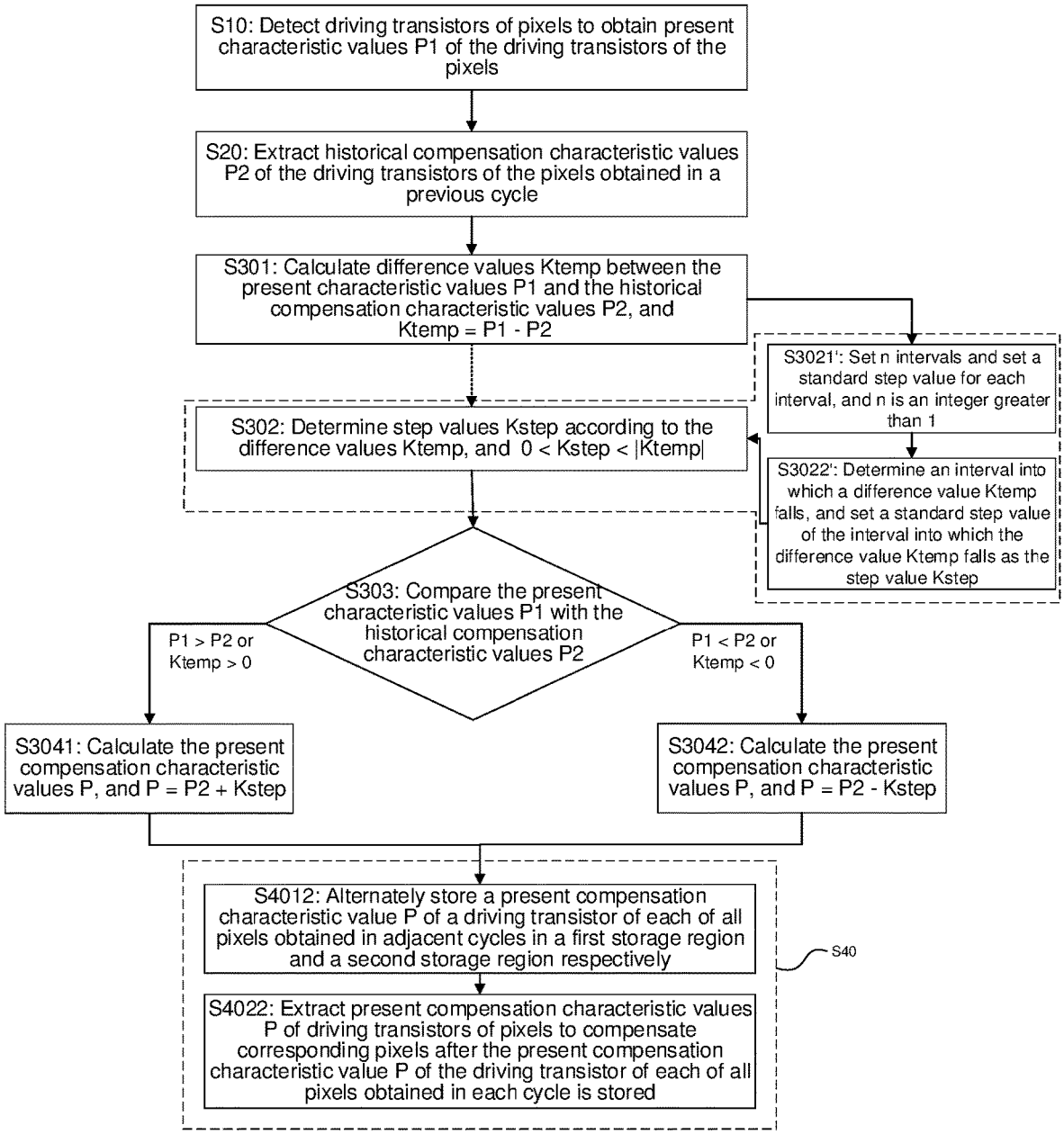
FIG. 7 is a flow diagram of a third variation of the pixel compensation method shown in FIG. 4, in accordance with some embodiments.

In some embodiments of the present disclosure, referring to FIG. 7, except for the step S40 of compensating corresponding pixels according to the present compensation characteristic values P of the driving transistors of the pixels, other steps are all the same as those in the pixel compensation method in the embodiments shown in FIG. 4, and will not be described herein again. As shown in FIG. 7, S40 may include the following steps.

In S4012, present compensation characteristic values P of driving transistors of all pixels respectively obtained in a plurality of adjacent display cycles of a screen are alternately stored in a first storage region and a second storage region.

In S4022, after present compensation characteristic values P of the driving transistors of all pixels obtained in a display cycle of the screen are stored, the present compensation characteristic values P of driving transistors of pixels are extracted to compensate corresponding pixels.

Figure 8:
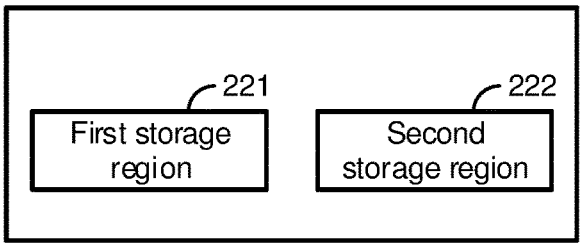
FIG. 8 is a schematic diagram of a first storage structure for storing present compensation characteristic values, in accordance with some embodiments.

For example, referring to FIG. 8, the display apparatus may include a first storage region 221 and a second storage region 222. The present compensation characteristic values P of the driving transistors of all pixels respectively obtained in the plurality of adjacent display cycles of the screen are alternately stored in the first storage region 221 and the second storage region 222. Moreover, in a plurality of display scanning times in display periods of different frames of images in the adjacent display cycles of the screen, present compensation characteristic values of driving transistors of pixels obtained in previous display cycles of the screen are alternately extracted from the first storage region 221 and the second storage region 222 to compensate corresponding pixels.

In some embodiments of the present disclosure, in a plurality of blanking times in an sth display cycle of the screen, pixels from the first row of pixels Pixel1 to the Nth row of pixels PixelN are sequentially scanned, so as to obtain the present compensation characteristic values P of the driving transistors of all pixels, and the present compensation characteristic values P of the driving transistors of all pixels obtained in the sth display cycle of the screen are stored in the first storage region 221. In a plurality of display scanning times in the sth display cycle of the screen, present compensation characteristic values P of the driving transistors of all pixels obtained in an (s−1)th display cycle of the screen and stored in the second storage region 222 are extracted to compensate corresponding pixels.

After the present compensation characteristic values P of the driving transistors of all pixels are obtained in the sth display cycle of the screen, that is, after the present compensation characteristic values P of the driving transistors of all pixels obtained in the sth display cycle of the screen are stored, a process of obtaining the present compensation characteristic values P of the driving transistors of all pixels in an (s+1)th display cycle of the display screen will begin. In a plurality of blanking times of the (s+1)th display cycle of the display screen, pixels from the first row of pixels Pixel1 to the Nth row of pixels PixelN are sequentially scanned, and the obtained present compensation characteristic values P of the driving transistors of all pixels are stored in the second storage region 222. In a plurality of display scanning times of the (s+1)th display cycle of the display screen, present compensation characteristic values P of the driving transistors of all pixels obtained in the sth display cycle of the screen and stored in the first storage region 221 are extracted to compensate corresponding pixels.

After the present compensation characteristic values P of the driving transistors of all pixels are obtained in the (s+1)th display cycle of the screen, that is, after the present compensation characteristic values P of the driving transistors of all pixels obtained in the (s+1)th display cycle of the screen are stored, a process of obtaining the present compensation characteristic values P of the driving transistors of all pixels in an (s+2)th display cycle of the display screen will begin. In a plurality of blanking times of the (s+2)th display cycle of the display screen, pixels from the first row of pixels Pixel1 to the Nth row of pixels PixelN are sequentially scanned, and the obtained present compensation characteristic values P of the driving transistors of all pixels are stored in the first storage region 221. In a plurality of display scanning times of the (s+2)th display cycle of the display screen, the present compensation characteristic values P of the driving transistors of all pixels obtained in the (s+1)th display cycle of the screen and stored in the second storage region 222 are extracted to compensate corresponding pixels. In this way, the present compensation characteristic values P are alternately stored and alternately extracted, so as to achieve compensation of the pixels.

Variation 4

Figure 9:
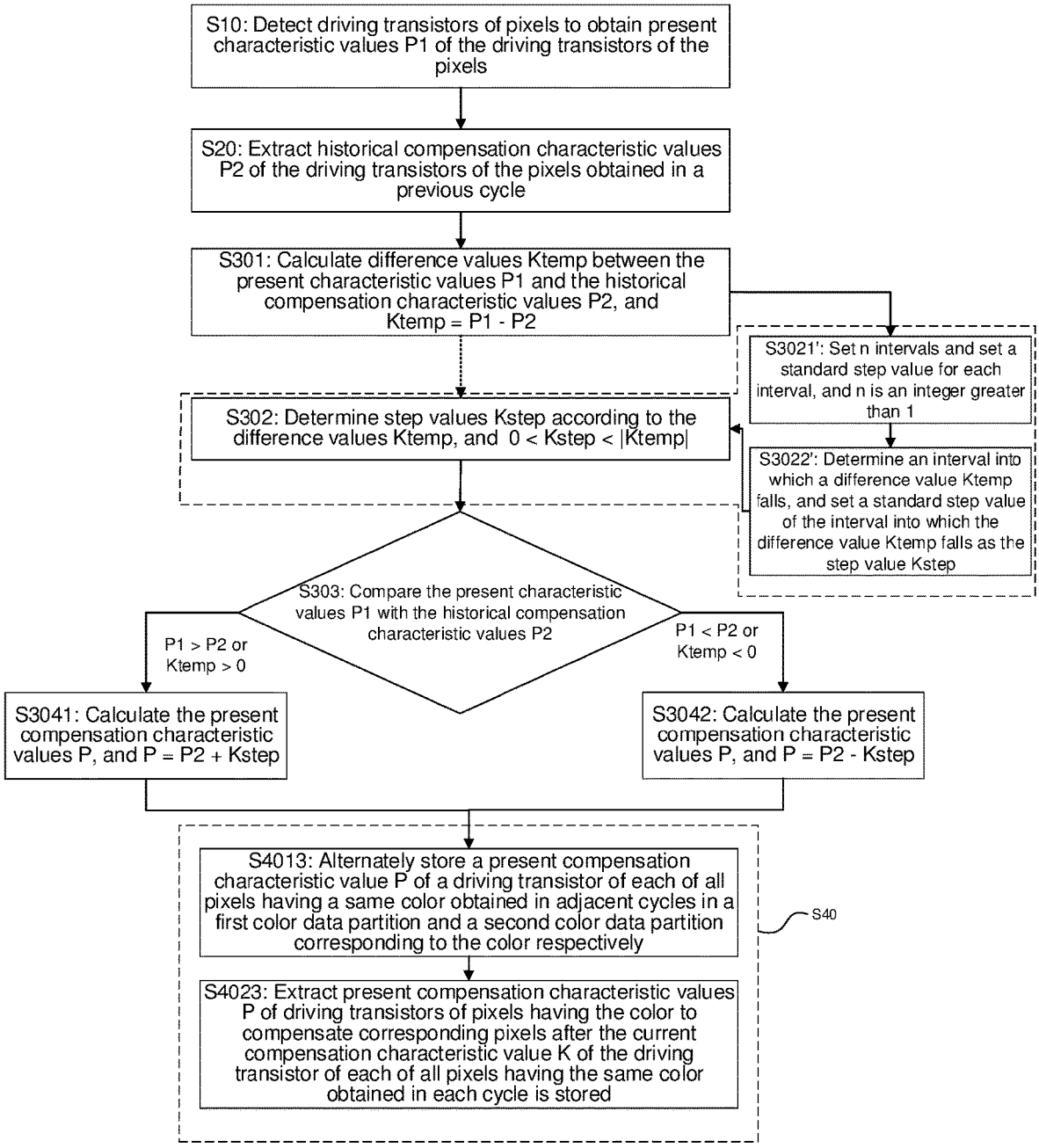
FIG. 9 is a flow diagram of a fourth variation of the pixel compensation method shown in FIG. 4, in accordance with some embodiments.

In some embodiments of the present disclosure, referring to FIG. 9, except for the step S40 of compensating corresponding pixels according to the present compensation characteristic values P of the driving transistors of the pixels, other steps are all the same as those in the pixel compensation method in the embodiments shown in FIG. 4, and will not be described herein again. As shown in FIG. 9, S40 may include the following steps.

In S4013, present compensation characteristic values P of driving transistors of all pixels having a same color respectively obtained in a plurality of adjacent display cycles of a screen are alternately stored in a first color data partition and a second color data partition corresponding to the color.

Figure 10:
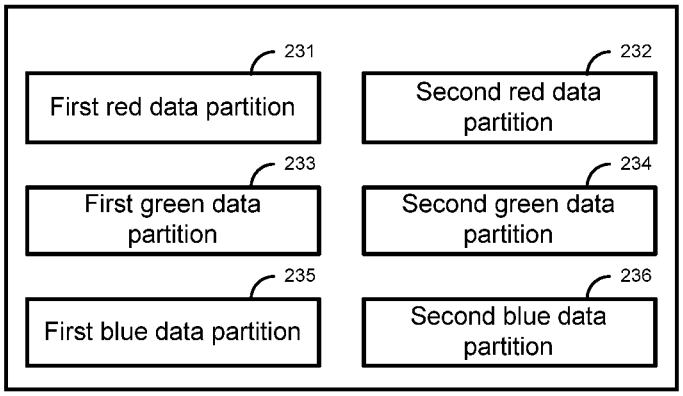
FIG. 10 is a schematic diagram of a second storage structure for storing present compensation characteristic values, in accordance with some embodiments.

For example, referring to FIGS. 2 to 10, the display apparatus adopts the RGB color mode. Among the plurality of pixels of the display apparatus, as shown in FIG. 2, one third of the pixels are R pixels 1, one third of the pixels are G pixels 2, and one third of the pixels are B pixels 3. The plurality of pixels of the display apparatus are divided into N rows, and a plurality of R pixels 1, a plurality of G pixels 2 and a plurality of B pixels 3 in each row of pixels are all arranged repeatedly in the order of R pixel 1, G pixel 2 and B pixel 3. As shown in FIG. 10, red corresponds to a first red data partition 231 and a second red data partition 232, green corresponds to a first green data partition 233 and a second green data partition 234, and blue corresponds to a first blue data partition 235 and a second blue data partition 236.

The present compensation characteristic values P of the driving transistors of all R pixels 1 respectively obtained in a plurality of adjacent display cycles of the screen are alternately stored in the first red data partition 231 and the second red data partition 232. The present compensation characteristic values P of the driving transistors of all G pixels 2 respectively obtained in the plurality of adjacent display cycles of the screen are alternately stored in the first green data partition 233 and the second green data partition 234. The present compensation characteristic values P of the driving transistors of all B pixels 3 respectively obtained in the plurality of adjacent display cycles of the screen are alternately stored in the first blue data partition 235 and the second blue data partition 236.

It will be understood that, in order to make the first detection value more accurately reflect a difference in magnitudes of parameters K of driving transistors in different pixel circuits emitting light of a same color, first preset time corresponding to all the pixel circuits emitting the light of the same color of the plurality of pixel circuits may be set equal. And/or, first preset voltages corresponding to all the pixel circuits emitting the light of the same color of the plurality of pixel circuits are equal. In addition, first preset time and/or first preset voltages corresponding to pixel circuits emitting light of different colors may be equal or unequal, and may be set according to actual application requirements.

In S4023, after present compensation characteristic values P of the driving transistors of all pixels having the same color obtained in a display cycle of the screen are stored, the present compensation characteristic values P of driving transistors of pixels having the color are extracted to compensate corresponding pixels, and any color in a color mode of a display apparatus corresponds to a first color data partition and a second color data partition.

It will be further noted that, a purpose of compensating the data voltages to be applied to the pixel circuits may include causing different pixel circuits emitting the light of the same color to provide driving currents of a same magnitude to the organic light-emitting diodes when data voltages of a same magnitude are applied to the different pixel circuits emitting the light of the same color. Since a difference among the driving currents supplied to the organic light-emitting diodes when the data voltages of the same magnitude are applied to different pixel circuits emitting the light of the same color is mainly due to a difference among the driving transistors of different pixel circuits, and the threshold voltages and the first detection values described above may independently reflect the difference among the driving transistors of different pixel circuits emitting the light of the same color, a deviation in the data voltages due to a difference among the threshold voltages of the driving transistors in different pixel circuits emitting the light of the same color may be compensated according to the threshold voltages, and deviations in the data voltages due to differences among device parameters (for example, the above parameters K integrating the channel widths, the channel lengths, the carrier mobilities, and the capacitances per unit area of the gate insulating layers described above) other than the threshold voltages of the driving transistors in different pixel circuits emitting the light of the same color may be compensated according to the first detection values obtained. Moreover, other than that the above compensation may be performed among the pixel circuits emitting the light of the same color, it is also possible to perform the above compensation among pixel circuits emitting light of more than one color or among pixel circuits emitting light of all colors. Principles on which the compensations are based are consistent, and are not described herein again.

Similarly, referring to FIGS. 2 and 10, in a plurality of display scanning times in display periods of different frames of images in a plurality of adjacent display cycles of the screen, present compensation characteristic values P of the driving transistors of all R pixels 1 obtained in previous display cycles of the screen are alternately extracted from the first red data partition 231 and the second red data partition 232 to compensate corresponding R pixels 1; present compensation characteristic values P of the driving transistors of all G pixels 2 obtained in the previous display cycles of the screen are alternately extracted from the first green data partition 233 and the second green data partition 234 to compensate corresponding G pixels 2; and present compensation characteristic values P of the driving transistors of all B pixels 3 obtained in the previous display cycles of the screen are alternately extracted from the first blue data partition 235 and the second blue data partition 236 to compensate corresponding B pixels 3.

In some embodiments of the present disclosure, when obtaining the present compensation characteristic values P of the driving transistors of all pixels in each display cycle of the screen, the present compensation characteristic values P of the driving transistors of all R pixels 1 are obtained first, the present compensation characteristic values P of the driving transistors of all G pixels 2 are obtained next, and the present compensation characteristic values P of the driving transistors of all B pixels 3 are obtained at last.

In a plurality of blanking times of a tth display cycle of the screen, in a first third of the blanking times, pixels from the first row of pixels Pixel1 to the Nth row of pixels PixelN are sequentially scanned, so as to obtain the present compensation characteristic values P of the driving transistors of all R pixels 1, and present compensation characteristic values P of the driving transistors of all R pixels 1 obtained in the tth display cycle of the screen are stored in the first red data partition 231. In a plurality of adjacent display scanning times of the tth display cycle of the screen: present compensation characteristic values P of the driving transistors of all R pixels 1 obtained in a (t−1)th display cycle of the screen and stored in the second red data partition 232 are extracted to compensate corresponding R pixels 1; present compensation characteristic values P of the driving transistors of all G pixels 2 obtained in the (t−1)th display cycle of the screen and stored in the second green data partition 234 are extracted to compensate corresponding G pixels 2; and present compensation characteristic values P of the driving transistors of all B pixels 3 obtained in the (t−1)th display cycle of the screen and stored in the second blue data partition 236 are extracted to compensate corresponding B pixels 3.

After the present compensation characteristic values P of the driving transistors of all R pixels 1 are obtained in the tth display cycle of the screen, that is, after the present compensation characteristic values P of the driving transistors of all R pixels 1 obtained in the tth display cycle of the screen are stored, in a middle third of the blanking times, pixels from the first row of pixels Pixel1 to the Nth row of pixels PixelN are sequentially scanned again, so as to obtain present compensation characteristic values P of the driving transistors of all G pixels 2.

The present compensation characteristic values P of the driving transistors of all G pixels 2 obtained in the tth display cycle of the screen are stored in the first green data partition 233. In a plurality of display scanning times of the tth display cycle of the screen: the present compensation characteristic values P of the driving transistors of all R pixels 1 obtained in the tth display cycle of the screen and stored in the first red data partition 231 are extracted to compensate corresponding R pixels 1; the present compensation characteristic values P of the driving transistors of all G pixels 2 obtained in the (t−1)th display cycle of the screen and stored in the second green data partition 234 are extracted to compensate corresponding G pixels 2; and the present compensation characteristic values P of the driving transistors of all B pixels 3 obtained in the (t−1)th display cycle of the screen and stored in the second blue data partition 236 are extracted to compensate corresponding B pixels 3.

After the present compensation characteristic values P of the driving transistors of all G pixels 2 are obtained in the tth display cycle of the screen, that is, after the present compensation characteristic values P of the driving transistors of all G pixels 2 obtained in the tth display cycle of the screen are stored, in a last third of the blanking times, pixels from the first row of pixels Pixel1 to the Nth row of pixels PixelN are sequentially scanned again, so as to obtain the present compensation characteristic values P of the driving transistors of all B pixels 3.

The present compensation characteristic values P of the driving transistors of all B pixels 3 obtained in the tth display cycle of the screen are stored in the first blue data partition 235. In a plurality of display times of the tth display cycle of the screen: the present compensation characteristic values P of the driving transistors of all R pixels 1 obtained in the tth display cycle of the screen and stored in the first red data partition 231 are extracted to compensate corresponding R pixels 1; the present compensation characteristic values P of the driving transistors of all G pixels 2 obtained in the tth display cycle of the screen and stored in the first green data partition 233 are extracted to compensate corresponding G pixels 2; and the present compensation characteristic values P of the driving transistors of all B pixels 3 obtained in the (t−1)th display cycle of the screen and stored in the second blue data partition 236 are extracted to compensate corresponding B pixels 3.

After the present compensation characteristic values P of the driving transistors of all B pixels 3 are obtained in the tth display cycle of the screen, that is, after the present compensation characteristic values P of the driving transistors of all B pixels 3 obtained in the tth display cycle of the screen are stored, a process of obtaining the present compensation characteristic values P of the driving transistors of all pixels in a (t+1)th display cycle of the display screen will begin.

Similarly, the present compensation characteristic values P of the driving transistors of all R pixels 1 are obtained first, the present compensation characteristic values P of the driving transistors of all G pixels 2 are obtained next, and the present compensation characteristic values P of the driving transistors of all B pixels 3 are obtained at last.

In the (t+1)th display cycle of the screen, in a case where the present compensation characteristic values P of the driving transistors of all R pixels 1 are obtained, in a case where the present compensation characteristic values P of the driving transistors of all G pixels 2 are obtained, and in a case where the present compensation characteristic values P of the driving transistors of all B pixels 3 are obtained, the present compensation characteristic values P of the driving transistors of all B pixels 3 obtained in the tth display cycle of the screen and stored in the first blue data partition 235 are extracted for compensating corresponding B pixels 3 in the plurality of display scanning times of of the display periods of the (t+1)th display cycle of the screen.

Present compensation characteristic values P of the driving transistors of all R pixels 1 obtained in the (t+1)th display cycle of the screen are stored in the second red data partition 232. Present compensation characteristic values P of the driving transistors of all G pixels 2 obtained in the (t+1)th display cycle of the screen are stored in the second green data partition 234. Present compensation characteristic values P of the driving transistors of all B pixels 3 obtained in the (t+1)th display cycle of the screen are stored in the second blue data partition 236.

Figure 12:
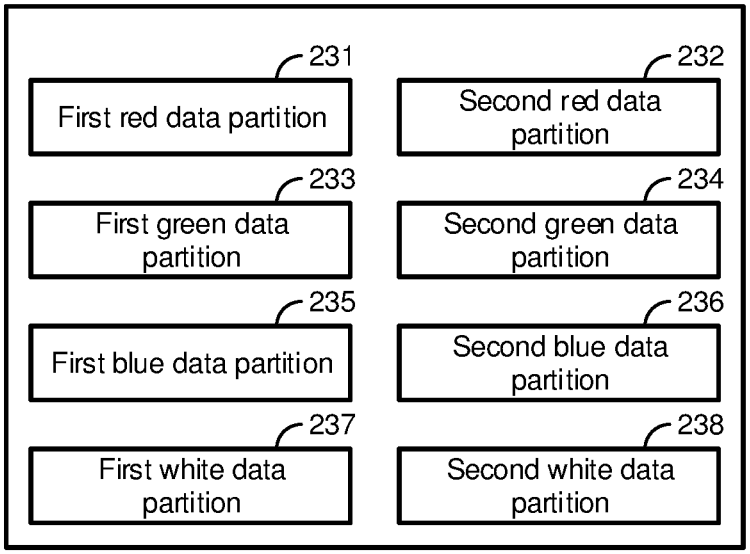
FIG. 12 is a schematic diagram of a third storage structure for storing present compensation characteristic values, in accordance with some embodiments.

In some embodiments of the present disclosure, referring to FIGS. 11 and 12, the display apparatus adopts an RGBW color mode. Among the plurality of pixels of the display apparatus, one quarter of the pixels are R pixels 1, one quarter of the pixels are G pixels 2, one quarter of the pixels are B pixels 3, and one quarter of the pixels are W pixels 4.

The plurality of pixels of the display apparatus are divided into N rows, and a plurality of R pixels 1, a plurality of G pixels 2, a plurality of B pixels 3, and a plurality of W pixels 4 in each row of pixels are all arranged repeatedly in an order of R pixel 1, G pixel 2, B pixel 3, and W pixel 4. Red corresponds to a first red data partition 231 and a second red data partition 232, green corresponds to a first green data partition 233 and a second green data partition 234, blue corresponds to a first blue data partition 235 and a second blue data partition 236, and white corresponds to a first white data partition 237 and a second white data partition 238.

When obtaining present compensation characteristic values P of the driving transistors of all pixels, present compensation characteristic values P of the driving transistors of all R pixels 1 respectively obtained in a plurality of adjacent display cycles of the screen are alternately stored in the first red data partition 231 and the second red data partition 232; present compensation characteristic values P of the driving transistors of all G pixels 2 respectively obtained in the plurality of adjacent display cycles of the screen are alternately stored in the first green data partition 233 and the second green data partition 234; present compensation characteristic values P of the driving transistors of all B pixels 3 respectively obtained in the plurality of adjacent display cycles of the screen are alternately stored in the first blue data partition 235 and the second blue data partition 236; and present compensation characteristic values P of the driving transistors of all W pixels 4 respectively obtained in the plurality of adjacent display cycles of the screen are alternately stored in the first white data partition 237 and the second white data partition 238.

Moreover, in a plurality of display scanning times in the plurality of adjacent display cycles of the screen, the present compensation characteristic values P of the driving transistors of all R pixels 1 respectively obtained in previous display cycles of the screen are alternately extracted from the first red data partition 231 and the second red data partition 232 to compensate corresponding R pixels 1; the present compensation characteristic values P of the driving transistors of all G pixels 2 respectively obtained in the previous display cycles of the screen are alternately extracted from the first green data partition 233 and the second green data partition 234 to compensate corresponding G pixels 2; the present compensation characteristic values P of the driving transistors of all B pixels 3 respectively obtained in the previous display cycles of the screen are alternately extracted from the first blue data partition 235 and the second blue data partition 236 to compensate corresponding B pixels 3; and the present compensation characteristic values P of the driving transistors of all W pixels 4 respectively obtained in the previous display cycles of the screen are alternately extracted from the first white data partition 237 and the second white data partition 238 to compensate corresponding W pixels 4.

In some embodiments of the present disclosure, when obtaining the present compensation characteristic values P of the driving transistors of all pixels in a display cycle of the screen, the present compensation characteristic values P of the driving transistors of all R pixels 1 are obtained first, the present compensation characteristic values P of the driving transistors of all G pixels 2 are obtained next, the present compensation characteristic values P of the driving transistors of all B pixels 3 are obtained still next, and the present compensation characteristic values P of the driving transistors of all W pixels 4 are obtained at last.

In a plurality of blanking times of a tth display cycle of the screen, in a first quarter of the blanking times, pixels from the first row of pixels Pixel1 to the Nth row of pixels PixelN are sequentially scanned, so as to obtain present compensation characteristic values P of the driving transistors of all R pixels 1, the present compensation characteristic values P of the driving transistors of all R pixels 1 obtained in the tth display cycle of the screen are stored in the first red data partition 231. In a plurality of display scanning times of the tth display cycle of the screen: present compensation characteristic values P of the driving transistors of all R pixels 1 obtained in a (t−1)th display cycle of the screen and stored in the second red data partition 232 are extracted to compensate corresponding R pixels 1; present compensation characteristic values P of the driving transistors of all G pixels 2 obtained in the (t−1)th display cycle of the screen and stored in the second green data partition 234 are extracted to compensate corresponding G pixels 2; present compensation characteristic values P of the driving transistors of all B pixels 3 obtained in the (t−1)th display cycle of the screen and stored in the second blue data partition 236 are extracted to compensate corresponding B pixels 3; and present compensation characteristic values P of the driving transistors of all W pixels 4 obtained in the (t−1)th display cycle of the screen and stored in the second white data partition 238 are extracted to compensate corresponding W pixels 4.

After the present compensation characteristic values P of the driving transistors of all R pixels 1 are obtained in the tth display cycle of the screen, that is, after the present compensation characteristic values P of the driving transistors of all R pixels 1 obtained in the tth display cycle of the screen are stored, in a second quarter of the blanking times, pixels from the first row of pixels Pixel1 to the Nth row of pixels PixelN are sequentially scanned again, so as to obtain present compensation characteristic values P of the driving transistors of all G pixels 2. The present compensation characteristic values P of the driving transistors of all G pixels 2 obtained in the tth display cycle of the screen are stored in the first green data partition 233.

In a plurality of display scanning times of the tth display cycle of the screen: the present compensation characteristic values P of the driving transistors of all R pixels 1 obtained in the tth display cycle of the screen and stored in the first red data partition 231 are extracted to compensate corresponding R pixels 1; the present compensation characteristic values P of the driving transistors of all G pixels 2 obtained in the (t−1)th display cycle of the screen and stored in the second green data partition 234 are extracted to compensate corresponding G pixels 2; the present compensation characteristic values P of the driving transistors of all B pixels 3 obtained in the (t−1)th display cycle of the screen and stored in the second blue data partition 236 are extracted to compensate corresponding B pixels 3; and the present compensation characteristic values P of the driving transistors of all W pixels 4 obtained in the (t−1)th display cycle of the screen and stored in the second white data partition 238 are extracted to compensate corresponding W pixels 4.

After the present compensation characteristic values P of the driving transistors of all G pixels 2 are obtained in the tth display cycle of the screen, that is, after the present compensation characteristic values P of the driving transistors of all G pixels 2 obtained in the tth display cycle of the screen are stored, in a third quarter of the blanking times, pixels from the first row of pixels Pixel1 to the Nth row of pixels PixelN are sequentially scanned again, so as to obtain present compensation characteristic values P of the driving transistors of all B pixels 3. The present compensation characteristic values P of the driving transistors of all B pixels 3 obtained in the tth display cycle of the screen are stored in the first blue data partition 235.

In a plurality of display scanning times of the tth display cycle of the screen: the present compensation characteristic values P of the driving transistors of all R pixels 1 obtained in the tth display cycle of the screen and stored in the first red data partition 231 are extracted to compensate corresponding R pixels 1; the present compensation characteristic values P of the driving transistors of all G pixels 2 obtained in the tth display cycle of the screen and stored in the first green data partition 233 are extracted to compensate corresponding G pixels 2; the present compensation characteristic values P of the driving transistors of all B pixels 3 obtained in the (t−1)th display cycle of the screen and stored in the second blue data partition 236 are extracted to compensate corresponding B pixels 3; and the present compensation characteristic values P of the driving transistors of all W pixels 4 obtained in the (t−1)th display cycle of the screen and stored in the second white data partition 238 are extracted to compensate corresponding W pixels 4.

After the present compensation characteristic values P of the driving transistors of all B pixels 3 are obtained in the tth display cycle of the screen, that is, after the present compensation characteristic values P of the driving transistors of all B pixels 3 obtained in the tth display cycle of the screen are stored, in a last quarter of the blanking times, pixels from the first row of pixels Pixel1 to the Nth row of pixels PixelN are sequentially scanned again, so as to obtain present compensation characteristic values P of the driving transistors of all W pixels 4. The present compensation characteristic values P of the driving transistors of all W pixels 4 obtained in the tth display cycle of the screen are stored in the first white data partition 237.

In a plurality of display scanning times of the tth display cycle of the screen: the present compensation characteristic values P of the driving transistors of all R pixels 2 obtained in the tth display cycle of the screen and stored in the first red data partition 231 are extracted to compensate corresponding R pixels 1; the present compensation characteristic values P of the driving transistors of all G pixels 2 obtained in the tth display cycle of the screen and stored in the first green data partition 233 are extracted to compensate corresponding G pixels 2; the present compensation characteristic values P of the driving transistors of all B pixels 3 obtained in the tth display cycle of the screen and stored in the first blue data partition 235 are extracted to compensate corresponding B pixels 3; and the present compensation characteristic values P of the driving transistors of all W pixels 4 obtained in the (t−1)th display cycle of the screen and stored in the second white data partition 238 are extracted to compensate corresponding W pixels 4.

After the present compensation characteristic values P of the driving transistors of all W pixels 4 are obtained in the tth display cycle of the screen, that is, after the present compensation characteristic values P of the driving transistors of all W pixels 4 obtained in the tth display cycle of the screen are stored, a process of obtaining the present compensation characteristic values P of the driving transistors of all pixels in a (t+1)th display cycle of the screen will begin.

Similarly, present compensation characteristic values P of the driving transistors of all R pixels 1 are obtained first, present compensation characteristic values P of the driving transistors of all G pixels 2 are obtained next, present compensation characteristic values P of the driving transistors of all B pixels 3 are obtained still next, and present compensation characteristic values P of the driving transistors of all W pixels 4 are obtained at last.

In the (t+1)th display cycle of the screen, in a case where the present compensation characteristic values P of the driving transistors of all R pixels 1 are obtained, in a case where the present compensation characteristic values P of the driving transistors of all G pixels 2 are obtained, in a case where the present compensation characteristic values P of the driving transistors of all B pixels 3 are obtained, and in a case where the present compensation characteristic values P of the driving transistors of all W pixels 4 are obtained, the present compensation characteristic values P of the driving transistors of all W pixels 4 obtained in the tth display cycle of the screen and stored in the first white data partition 237 are extracted for compensating corresponding W pixels 4 in a plurality of display scanning times of the display period in the (t+1)th display cycle of the screen. The present compensation characteristic values P of the driving transistors of all R pixels 1 obtained in the (t+1)th display cycle of the screen are stored in the second red data partition 232; the present compensation characteristic values P of the driving transistors of all G pixels 2 obtained in the (t+1)th display cycle of the screen are stored in the second green data partition 234; the present compensation characteristic values P of the driving transistors of all B pixels 3 obtained in the (t+1)th display cycle of the screen are stored in the second blue data partition 236; and the present compensation characteristic values P of the driving transistors of all W pixels 4 obtained in the (t+1)th display cycle of the screen are stored in the second white data partition 238.

In some embodiments of the present disclosure, the display apparatus implementing the above method may be divided into a plurality of functional modules according to the above method examples. For example, the functional modules may be divieded in a way that each functional module corresponds to one function, or two or more functions may be integrated into one functional module. The above integrated functional modules may be implemented in the form of hardware or in the form of software functional modules. It will be noted that the division of the functional modules in some embodiments of the present disclosure is schematic, and is only a logical functional division, and there may be other ways to divide the functional modules in actual implementation.

In some embodiments of the present disclosure, referring to FIGS. 13 to 16, a pixel compensation system adopting the pixel compensation method described in the above embodiments is further provided.

Figure 13:
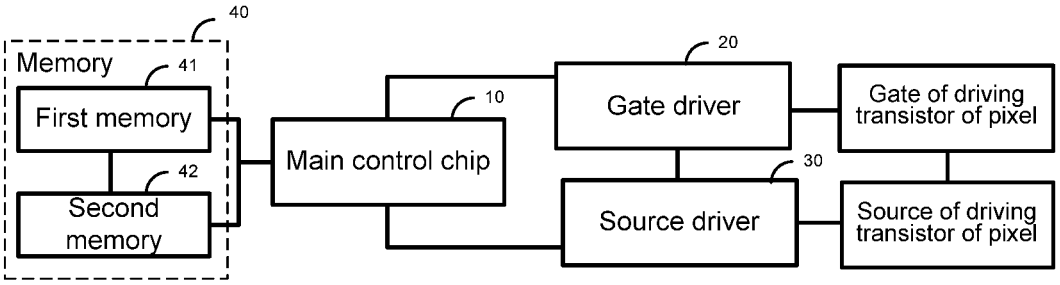
FIG. 13 is a schematic diagram showing a structure of a pixel compensation system, in accordance with some embodiments.

As shown in FIG. 13, the pixel compensation system includes a main control chip 10, a gate driver 20, and a source driver 30. The main control chip 10 is electrically connected to the gate driver 20 and the source driver 30. The gate driver 20 is electrically connected to a pixel circuit of each pixel, and the source driver 30 is electrically connected to the pixel circuit of the pixel. The main control chip 10 is configured to obtain present compensation characteristic values P of driving transistors of pixels. The gate driver 20 and the source driver 30 are configured to compensate corresponding pixels using the obtained present compensation characteristic values P of the driving transistors of the pixels.

The compensation process may be refer to the above method, which will not be described again.

Various embodiments in the present disclosure are described in a progressive manner. As for the same or similar parts between the various embodiments, reference may be made to each other. Each embodiment focuses on differences between the embodiment and other embodiments. In particular, since embodiments of systems are substantially similar to embodiments of methods, descriptions thereof are relatively simple. For relevant information, reference may be made to part of description in the embodiments of methods.

In the pixel compensation system provided in embodiments of the present disclosure, the main control chip 10 is further configured to: detect the driving transistors of the pixels to obtain present characteristic values P1 of the driving transistors of the pixels; extract historical compensation characteristic values P2 of the driving transistors of the pixels obtained in a previous display cycle of the screen; and calculate present compensation characteristic values P of the driving transistors of the pixels.

In the pixel compensation system provided in some embodiments of the present disclosure, the main control chip 10 is further configured to: calculate a difference value Ktemp between each present characteristic value P1 and a corresponding historical compensation characteristic value P2, Ktemp being a difference between P1 and P2 (Ktemp=P1−P2); Determine a step value Kstep according to the difference value Ktemp, Kstep being greater than 0 and less than an absolute value of Ktemp ($0<Kstep<|Ktemp|$); compare the present characteristic value P1 with the historical compensation characteristic value P2; and calculate the present compensation characteristic value P according to the present characteristic value P1, the historical compensation characteristic value P2, and the step value Kstep. In a case where the present characteristic value P1 is greater than the historical compensation characteristic value P2, P is a sum of P2 and Kstep (P=P2+Kstep); and in a case where the present characteristic value P1 is less than the historical compensation characteristic value P2, P is a difference between P2 and Kstep (P=P2−Kstep).

Alternatively, in the pixel compensation system provided in some embodiments of the present disclosure, the main control chip 10 may be further configured to: calculate a difference value Ktemp between each present characteristic value P1 and a corresponding historical compensation characteristic value P2, Ktemp being a difference between P1 and P2 (Ktemp=P1−P2); determine a step value Kstep according to the difference value Ktemp, Kstep being greater than 0 and less than an absolute value of Ktemp (0<Kstep<|Ktemp|); compare the present characteristic value P1 with the historical compensation characteristic value P2; and calculate the present compensation characteristic value P according to the present characteristic value P1, the historical compensation characteristic value P2, and the step value Kstep. However, in a case where the present characteristic value P1 is greater than the historical compensation characteristic value P2, P is a difference between P1 and Kstep (P=P1−Kstep); and in a case where the present characteristic value P1 is less than the historical compensation characteristic value P2, P is a sum of P1 and Kstep (P=P1+Kstep).

In some embodiments of the present disclosure, in a case where the step value Kstep is determined according to a step size coefficient a and the difference value Ktemp, the main control chip 10 may set a step size coefficient a first, and a is less than 1 and greater than 0. Then, the main control chip 10 may calculate the step value Kstep according to the difference value Ktemp and the step size coefficient a, and Kstep is a product of a and the absolute value of Ktemp (Kstep=a×|Ktemp|).

In some embodiments of the present disclosure, in a case where the step value Kstep is determined according to an interval into which the difference value Ktemp falls, the main control chip 10 may set n intervals first, and n is an integer greater than 0. Moreover, among the n intervals, a value of a starting endpoint of an ith interval is equal to a value of an ending endpoint of an (i−1)th interval. In a case where the ith interval is closed at the starting endpoint of the ith interval, the (i−1)th interval is open at the ending endpoint of the (i−1)th interval, and in a case where the ith interval is open at the starting endpoint of the ith interval, the (i−1)th interval is closed at the ending endpoint of the (i−1)th interval. Herein, i is greater than or equal to 2 and less than or equal ton (2≤i≤n).

Then, the main control chip 10 may set a standard step value for each interval; determine an interval into which the difference value Ktemp falls; and set a standard step value corresponding to the interval into which the difference value Ktemp falls as the step value Kstep according to the interval into which the difference value Ktemp falls.

In some embodiments of the present disclosure, in a case where the solutions described in the above steps S4011 and S4021 are employed when the gate driver 20 and the source driver 30 compensate corresponding pixels according to the present compensation characteristic values P of the driving transistors of the pixels, referring to FIG. 13, the pixel compensation system may further include a memory 40 electrically connected to the main control chip 10. The memory 40 is configured to store the present compensation characteristic values P of the driving transistors of the pixels obtained by the main control chip 10. After the present compensation characteristic values P of the driving transistors of all pixels obtained in each display cycle of a screen are stored, the main control chip 10 will extract the present compensation characteristic values P of the driving transistors of the pixels from the memory 40, and transmit the present compensation characteristic values P to the gate driver 20 and the source driver 30, so as to compensate corresponding pixels.

In some embodiments of the present disclosure, in a case where the gate driver 20 and the source driver 30 compensate corresponding pixels according to the present compensation characteristic values of the driving transistors of the pixels, and the solutions described in the above steps S4012 and S4022 are adopted, referring to FIG. 13, the memory 40 may include a first memory 41 and a second memory 42. The first memory 41 and the second memory 42 are electrically connected to the main control chip 10, and the first memory 41 and the second memory 42 are configured to alternately store the present compensation characteristic values P of the driving transistors of all pixels respectively obtained in a plurality of adjacent display cycles of the screen.

During the process of alternately storing the present compensation characteristic values P of the driving transistors of all pixels obtained in the display cycle of the screens, the main control chip 10 will alternately extract present compensation characteristic values P of the driving transistors of the pixels from the first memory 41 and the second memory 42, and transmit the present compensation characteristic values P to the gate driver 20 and the source driver 30, so as to compensate corresponding pixels.

In some embodiments of the present disclosure, in a case where the solutions described in the above steps S4013 and S4023 are employed when the gate driver 20 and the source driver 30 compensate corresponding pixels according to the present compensation characteristic values P of the driving transistors of the pixels, the pixel compensation system may further include a first color data memory and a second color data memory.

Figure 14:
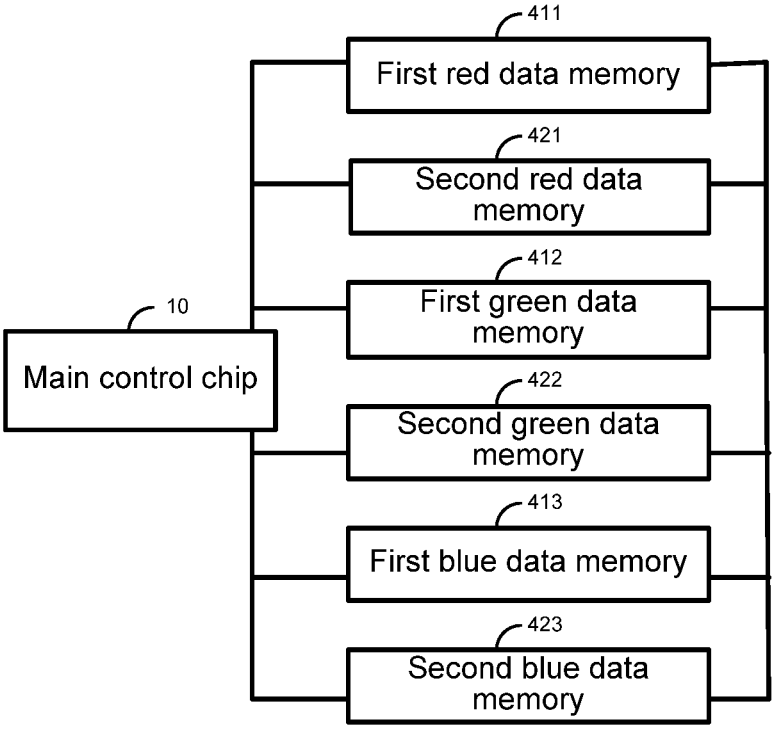
FIG. 14 is a schematic diagram showing a first structure of a memory in a pixel compensation system, in accordance with some embodiments.

As shown in FIG. 14, any color in the color mode of the display apparatus corresponds to a first color data memory and a second color data memory. The first color data memory and the second color data memory are electrically connected to the main control chip 10, and the first color data memory and the second color data memory of any color are configured to correspondingly and alternately store present compensation characteristic values P of the driving transistors of all pixels having the color respectively obtained in a plurality of adjacent display cycles of the screen.

After the present compensation characteristic values P of the driving transistors of all pixels having a same color obtained in each display cycle of the screen are stored, the main control chip 10 will extract the present compensation characteristic values P of the driving transistors of the pixels having the color, and transmit the present compensation characteristic values P to the gate driver 20 and the source driver 30, so as to compensate corresponding pixels.

In some embodiments of the present disclosure, in a case where the display apparatus adopts the RGB color mode, referring to FIG. 14, red corresponds to a first red data memory 411 and a second red data memory 421, green corresponds to a first green data memory 412 and a second green data memory 422, and blue corresponds to a first blue data memory 413 and a second blue data memory 423. That is, the pixel compensation system includes the first red data memory 411, the second red data memory 421, the first green data memory 412, the second green data memory 422, the first blue data memory 413, and the second blue data memory 423.

The first red data memory 411 and the second red data memory 421 are electrically connected to the main control chip 10, and the first red data memory 411 and the second red data memory 421 are configured to correspondingly and alternately store the present compensation characteristic values P of the driving transistors of all R pixels 1 respectively obtained in the plurality of adjacent display cycles of the screen.

The first green data memory 412 and the second green data memory 422 are electrically connected to the main control chip 10, and the first green data memory 412 and the second green data memory 422 are configured to correspondingly and alternately store the present compensation characteristic values P of the driving transistors of all G pixels 2 respectively obtained in the plurality of adjacent display cycles of the screen.

The first blue data memory 413 and the second blue data memory 423 are electrically connected to the main control chip 10, and the first blue data memory 413 and the second blue data memory 423 are configured to correspondingly and alternately store the present compensation characteristic values P of the driving transistors of all B pixels 3 respectively obtained in the plurality of adjacent display cycles of the screen.

In some embodiments of the present disclosure, the main control chip 10 is further configured to: after the present compensation characteristic values P of the driving transistors of all R pixels 1 obtained in a display cycle of the screen are stored, extract the present compensation characteristic values P of the driving transistors of the R pixels 1, and transmit the present compensation characteristic values P to the gate driver 20 and the source driver 30, so as to compensate corresponding R pixels 1; after the present compensation characteristic values P of the driving transistors of all G pixels 2 obtained in the display cycle of the screen are stored, extract the present compensation characteristic values P of the driving transistors of the G pixels 2, and transmit the present compensation characteristic values P to the gate driver 20 and the source driver 30, so as to compensate corresponding G pixels 2; and after the present compensation characteristic values P of the driving transistors of all B pixels 3 obtained in the display cycle of the screen are stored, extract the present compensation characteristic values P of the driving transistors of the B pixels 3, and transmit the present compensation characteristic values P to the gate driver 20 and the source driver 30, so as to compensate corresponding B pixels 3.

Figure 15:
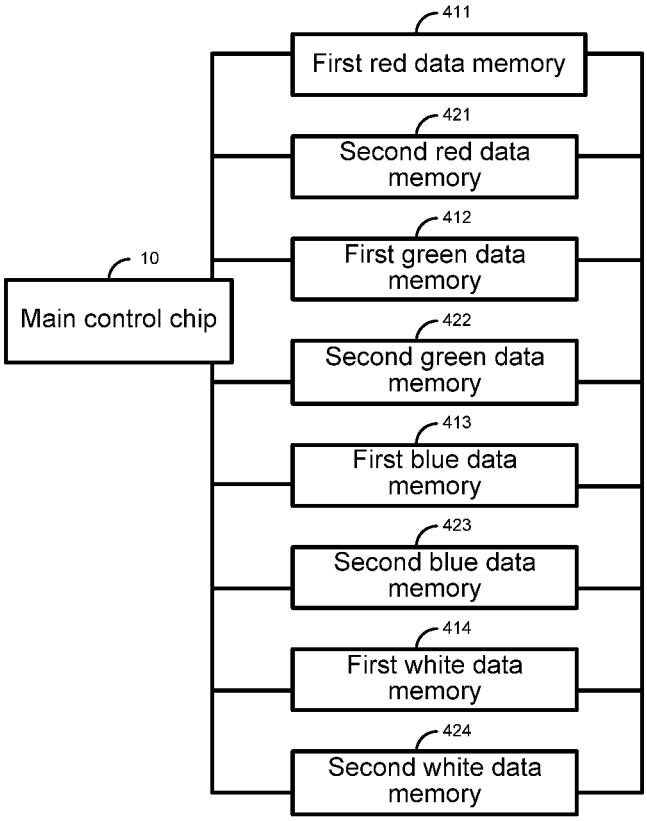
FIG. 15 is a schematic diagram showing a second structure of a memory in a pixel compensation system, in accordance with some embodiments.

In some embodiments of the present disclosure, in a case where the display apparatus adopts the RGBW color mode, referring to FIG. 15, red corresponds to a first red data memory 411 and a second red data memory 421, green corresponds to a first green data memory 412 and a second green data memory 422, blue corresponds to a first blue data memory 413 and a second blue data memory 423, and white corresponds to a first white data memory 414 and a second white data memory 424. That is, the pixel compensation system includes the first red data memory 411, the second red data memory 421, the first green data memory 412, the second green data memory 422, the first blue data memory 413, the second blue data memory 423, the first white data memory 414, and the second white data memory 424.

The first red data memory 411 and the second red data memory 421 are configured to correspondingly and alternately store present compensation characteristic values P of the driving transistors of all R pixels 1 respectively obtained in a plurality of adjacent display cycles of the screen.

The first green data memory 412 and the second green data memory 422 are configured to correspondingly and alternately store present compensation characteristic values P of the driving transistors of all G pixels 2 respectively obtained in the plurality of adjacent display cycles of the screen.

The first blue data memory 413 and the second blue data memory 423 are configured to correspondingly and alternately store present compensation characteristic values P of the driving transistors of all B pixels 3 respectively obtained in the plurality of adjacent display cycles of the screen.

The first white data memory 414 and the second white data memory 424 are configured to correspondingly and alternately store present compensation characteristic values P of the driving transistors of all W pixels 4 respectively obtained in the plurality of adjacent display cycles of the screen.

In some embodiments of the present disclosure, the main control chip 10 is further configured to: after the present compensation characteristic values P of the driving transistors of all R pixels 1 obtained in a display cycle of the screen are stored, extract the present compensation characteristic values P of the driving transistors of the R pixels 1, and transmit the present compensation characteristic values P to the gate driver 20 and the source driver 30, so as to compensate corresponding R pixels 1; after the present compensation characteristic values P of the driving transistors of all G pixels 2 obtained in the display cycle of the screen are stored, extract the present compensation characteristic values P of the driving transistors of the G pixels 2, and transmit the present compensation characteristic values P to the gate driver 20 and the source driver 30, so as to compensate corresponding G pixels 2; after the present compensation characteristic values P of the driving transistors of all B pixels 3 obtained in the display cycle of the screen are stored, extract the present compensation characteristic values P of the driving transistors of the B pixels 3, and transmit the present compensation characteristic values P to the gate driver 20 and the source driver 30, so as to compensate corresponding B pixels 3; and after the present compensation characteristic values P of the driving transistors of all W pixels 4 obtained in the display cycle of the screen are stored, extract the present compensation characteristic values P of the driving transistors of the W pixels 4, and transmit the present compensation characteristic values P to the gate driver 20 and the source driver 30, so as to compensate corresponding W pixels 4.

It will be noted that the above first memory and the second memory may be independent memorys, or different storage regions in a same memory.

Some embodiments of the present disclosure further provide a computer-readable storage medium (such as a non-transient computer-readable storage medium) storing program codes that, when executed by one or more main control chips of the display apparatus, cause the display apparatus to perform pixel compensation methods such as those shown in FIGS. 3-7 and 9.

The computer-readable storage medium can be a tangible device that can retain and store instructions for use by an instruction execution device. The computer-readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer-readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. In some embodiments, Aa computer-readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire. In some other embodiments, the computer-readable storage medium is transitory. For example, the computer-readable storage medium is a data stream.

Computer-readable program instructions described herein can be downloaded to respective computing/processing devices from a computer-readable storage medium or to an external computer or external storage device via a network, for example, the Internet, a local area network, a wide area network, and/or a wireless network. The network may comprise copper transmission cables, optical transmission fibers, wireless transmission, routers, firewalls, switches, gateway computers, and/or edge servers. A network adapter card or network interface in each computing/processing device receives computer-readable program instructions from the network and forwards the computer-readable program instructions for storage in a computer-readable storage medium within the respective computing/processing device.

Computer-readable program instructions for carrying out operations of the embodiments of present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++, or the like, and conventional procedural programming languages, such as the "C" programming language or similar programming languages. The computer-readable program instructions may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer-readable program instructions by utilizing state information of the computer-readable program instructions to personalize the electronic circuitry, in order to perform methods or processes of the embodiments of the present disclosure.

Aspects of the embodiments of present disclosure are described herein with reference to flowchart illustrations and/or block diagrams of methods, apparatus (systems), and the computer-readable storage medium according to embodiments of the disclosure. It will be understood that each block of the flowchart illustrations and/or block diagrams, and combinations of blocks in the flowchart illustrations and/or block diagrams, can be implemented by computer-readable program instructions.

These computer-readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer-readable program instructions also may be stored in a computer-readable storage medium that can direct a computer, a programmable data processing apparatus, and/or other devices to function in a particular manner, such that the computer-readable storage medium having instructions stored therein comprises an article of manufacture including instructions which implement aspects of the function/act specified in the flowchart and/or block diagram block or blocks.

The computer-readable program instructions also may be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and the computer-readable storage medium according to various embodiments of the present disclosure. In this regard, each block in the flowchart or block diagrams may represent a module, segment, or portion of instructions, which comprises one or more executable instructions for implementing the specified logical function(s). In some embodiments, the functions noted in the block may occur out of the order noted in the figures. For example, two blocks shown in succession are executed substantially concurrently, or the blocks are sometimes executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Some embodiments of the present disclosure further provide a program product that, when run on a display apparatus, causes the display apparatus to perform pixel compensation methods such as those shown in FIGS. 3-7 and 9.

In the above description of the embodiments, specific features, structures, materials or characteristics may be combined in any suitable manner in any one or more embodiments or examples.

The foregoing descriptions are merely some specific implementation manners of the present disclosure, but the protection scope of the present disclosure is not limited thereto. Any person skilled in the art could readily conceive of changes or replacements within the technical scope of the present disclosure, which shall all be included in the protection scope of the present disclosure. Therefore, the protection scope of the present disclosure shall be subject to the protection scope of the claims.

What is claimed is:

1. A pixel compensation method, comprising:

detecting driving transistors of pixels to obtain present characteristic values of the driving transistors of the pixels;

extracting historical compensation characteristic values of the driving transistors of the pixels obtained in a previous display cycle of a screen;

calculating a present compensation characteristic value of at least one driving transistor of the pixels according to a present characteristic value and a historical compensation characteristic value corresponding to the driving transistor of the pixels; and compensating a corresponding pixel according to the present compensation characteristic value of the driving transistor of the pixels;

wherein calculating the present compensation characteristic value of the at least one driving transistor of the pixels according to the present characteristic value and the historical compensation characteristic value corresponding to the driving transistor of the pixels, includes:

calculating a difference value between the present characteristic value and the historical compensation characteristic value, wherein the difference value is a difference between the present characteristic value and the historical compensation characteristic value;

determining a step value according to the difference value, wherein the step value is greater than 0 and less than an absolute value of the difference value;

comparing the present characteristic value with the historical compensation characteristic value; and calculating the present compensation characteristic value according to the present characteristic value, the historical compensation characteristic value and the step value, including:

setting the present compensation characteristic value as a sum of the historical compensation characteristic value and the step value in a case where the present characteristic value is greater than the historical compensation characteristic value; and setting the present compensation characteristic value as a difference between the historical compensation characteristic value and the step value in a case where the present characteristic value is less than the historical compensation characteristic value.

2. The pixel compensation method according to claim 1, wherein detecting the driving transistors of the pixels to obtain present characteristic values P1 of the driving transistors of the pixels, includes:

during each blanking time:

scanning at least one row of pixels in sequence, and detecting driving transistors of the scanned pixels to obtain present characteristic values of the driving transistors of the scanned pixels, wherein the blanking time is a period of time reserved between display scanning times of adjacent two frames of images.

3. The pixel compensation method according to claim 2, wherein detecting the driving transistors of the scanned pixels to obtain the present characteristic values of the driving transistors of the scanned pixels, includes:

detecting only driving transistors of pixels having a same color in the at least one row of pixels to obtain present characteristic values of the driving transistors of the pixels having the same color in the at least one row of pixels.

4. The pixel compensation method according to claim 1, wherein determining the step value according to the difference value, includes:

setting a step size coefficient, wherein the step size coefficient is less than 1 and greater than 0; and calculating the step value according to the difference value and the step size coefficient, wherein the step value is a product of the step size coefficient and the absolute value of the difference value.

5. The pixel compensation method according to claim 1, wherein determining the step value according to the difference value, includes:

setting n intervals, wherein n is an integer greater than 1, and among the n intervals, a value of a starting endpoint of an ith interval is equal to a value of an ending endpoint of an (i−1)th interval, wherein i is greater than or equal to 2 and less than or equal to n;

in a case where the (i−1)th interval is open at the ending endpoint of the (i−1)th interval, the ith interval is closed at the starting endpoint of the ith interval, and in a case where the (i−1)th interval is closed at the ending endpoint of the (i−1)th interval, the ith interval is open at the starting endpoint of the ith interval;

setting a standard step value for each interval;

determining an interval into which the difference value falls, and setting a standard step value corresponding to the interval into which the difference value falls as the step value.

6. The pixel compensation method according to claim 1, wherein compensating the corresponding pixel according to the present compensation characteristic value of the driving transistor of the pixels includes:

storing the present compensation characteristic value of the driving transistor of the pixels in a memory; and extracting the present compensation characteristic value of the driving transistor of the pixels from the memory to compensate the corresponding pixel.

7. The pixel compensation method according to claim 1, wherein compensating the corresponding pixel according to the present compensation characteristic value of the driving transistor of the pixels includes:

alternately storing present compensation characteristic values of driving transistors of pixels, which are respectively obtained in a plurality of adjacent display cycles of the screen, in a first storage region and a second storage region, and after present compensation characteristic values of the driving transistors of the pixels obtained in a display cycle of the screen in the plurality of adjacent display cycles of the screen are stored, extracting present compensation characteristic values of driving transistors of the pixels to compensate corresponding pixels.

8. The pixel compensation method according to claim 1, wherein compensating the corresponding pixel according to the present compensation characteristic value of the driving transistor of the pixels, includes:

alternately storing present compensation characteristic values of driving transistors of pixels having a same color respectively obtained in a plurality of adjacent display cycles of the screen in a first color data partition and a second color data partition corresponding to the color, and extracting present compensation characteristic values of driving transistors of pixels having the color to compensate corresponding pixels after the present compensation characteristic values of the driving transistors of the pixels having the same color obtained in a display cycle of the screen are stored, wherein any color in a color mode of a display apparatus corresponds to a first color data partition and a second color data partition.

9. A display apparatus, having a display area and a non-display area, wherein the display apparatus comprises gate lines and data lines disposed in the display area; the gate lines and the data lines are arranged crosswise without direct contact to form a plurality of pixels arranged in an array, and each pixel includes a driving transistor; and the display apparatus comprises following elements disposed in the non-display area:

a gate driver electrically connected to the gate lines;

a source driver electrically connected to the data lines;

a memory configured to store program codes including operation instructions; and one or more main control chips electrically connected to the gate driver, the source driver and the memory, and configured to, when executing the operation instructions, perform the pixel compensation method according to claim 1 and drive driving transistors to perform corresponding actions.

10. A non-transient computer-readable storage medium storing program codes that, when executed by one or more main control chips of the display apparatus, cause the display apparatus to perform the pixel compensation method according to claim 1.

11. The pixel compensation method according to claim 1, wherein calculating a present compensation characteristic value of at least one driving transistor of the pixels according to a present characteristic value and a historical compensation characteristic value corresponding to the driving transistor of the pixels, includes:

calculating a difference value between the present characteristic value and the historical compensation characteristic value, wherein the difference value is a difference between the present characteristic value and the historical compensation characteristic value;

determining a step value according to the difference value, wherein the step value is greater than 0 and less than an absolute value of the difference value;

comparing the present characteristic value with the historical compensation characteristic value; and calculating the present compensation characteristic value according to the present characteristic value, the historical compensation characteristic value and the step value, including:

setting the present compensation characteristic value as a difference between the present characteristic value and the step value in the case where the present characteristic value is greater than the historical compensation characteristic value; and setting the present compensation characteristic value as a sum of the present characteristic value and the step value in the case where the present characteristic value is less than the historical compensation characteristic value.

12. A pixel compensation system, comprising a main control chip, a gate driver and a source driver, wherein the main control chip is electrically connected to the gate driver and the source driver, and the gate driver and the source driver are configured to be electrically connected to a pixel circuit, which includes a driving transistor, of each pixel, wherein the main control chip is configured to:

detect driving transistors of pixels to obtain present characteristic values of the driving transistors of the pixels;

extract historical compensation characteristic values of the driving transistors of the pixels obtained in a previous display cycle of a screen; and calculate a present compensation characteristic value of at least one driving transistor of the pixels according to a present characteristic value and a historical compensation characteristic value corresponding to the driving transistor of the pixels; and the gate driver and the source driver are configured to compensate corresponding pixels using the obtained present compensation characteristic values of the driving transistors of the pixels wherein the main control chip is further configured to:

calculate a difference value between the present characteristic value and the historical compensation characteristic value, wherein the difference value is a difference between the present characteristic value and the historical compensation characteristic value;

determine a step value according to the difference value, wherein the step value is greater than 0 and less than an absolute value of the difference value;

compare the present characteristic value with the historical compensation characteristic value; and calculate the present compensation characteristic value according to the present characteristic value, the historical compensation characteristic value and the step value, wherein in a case where the present characteristic value is greater than the historical compensation characteristic value, the present compensation characteristic value is a sum of the historical compensation characteristic value and the step value; and in a case where the present characteristic value is less than the historical compensation characteristic value, the present compensation characteristic value is a difference between the historical compensation characteristic value and the step value.

13. The pixel compensation system according to claim 12, wherein the main control chip is configured to:

calculate a difference value between the present characteristic value and the historical compensation characteristic value, wherein difference value is a difference between the present characteristic value and the historical compensation characteristic value;

determine a step value according to the difference value, wherein the step value is greater than 0 and less than an absolute value of the difference value;

compare the present characteristic value with the historical compensation characteristic value; and calculate the present compensation characteristic value according to the present characteristic value, the historical compensation characteristic value and the step value, wherein in a case where the present characteristic value is greater than the historical compensation characteristic value, the present compensation characteristic value is a difference between the present characteristic value and the step value; and in a case where the present characteristic value is less than the historical compensation characteristic value, the present compensation characteristic value is a sum of the present characteristic value and the step value.

14. The pixel compensation system according to claim 12, wherein the main control chip is further configured to:

set a step size coefficient, wherein the step size coefficient is less than 1 and greater than 0; and calculate the step value according to the difference value and the step size coefficient, wherein the step value is a product of the step size coefficient and the absolute value of the difference value.

15. The pixel compensation system according to claim 12, wherein the main control chip is configured to:

set n intervals, wherein n is an integer greater than 0, and among the n intervals, a value of a starting endpoint of an ith interval is equal to a value of an ending endpoint of an (i−1)th interval; in a case where the ith interval is closed at the starting endpoint of the i-th interval, the (i−1)th interval is open at the ending endpoint of the (i−1)th interval, and in a case where the ith interval is open at the starting endpoint of the ith interval, the (i−1)th interval is closed at the ending endpoint of the (i−1)th interval, wherein i is greater than or equal to 2 and less than or equal to n;

set a standard step value for each interval;

determine an interval into which the difference value falls; and set a standard step value corresponding to the interval into which the difference value falls as the step value.

16. The pixel compensation system according to claim 12, further comprising a memory, wherein the memory is electrically connected to the control chip, and the memory is configured to store present compensation characteristic values of the driving transistors of the pixels; and the main control chip is further configured to, after the present compensation characteristic values of the driving transistors of all pixels obtained in a display cycle of a screen are stored, extract present compensation characteristic values of driving transistors of the pixels from the memory to compensate corresponding pixels.

17. The pixel compensation system according to claim 12, wherein the memory includes a first memory and a second memory, wherein the first memory and the second memory are electrically connected to the main control chip, and the first memory and the second memory are configured to alternately store present compensation characteristic values of driving transistor of all pixels respectively obtained in a plurality of adjacent display cycles of a screen; and the main control chip is further configured to, during a process of storing the present compensation characteristic values of the driving transistors of all pixels respectively obtained in the plurality of display cycles of the screen in the first memory and the second memory, alternately extract present compensation characteristic values of the driving transistors of the pixels from the first memory and the second memory to compensate corresponding pixels.

18. The pixel compensation system according to claim 12, wherein the system further comprises a first color data memory and a second color data memory, wherein any color in a color mode of a display apparatus corresponds to a first color data memory and a second color data memory; and the first color data memory and the second color data memory are electrically connected to the main control chip, and the first color data memory and the second color data memory are configured to:

correspondingly and alternately store present compensation characteristic values of driving transistors of all pixels having a corresponding color respectively obtained in a plurality of adjacent display cycles of a screen; and the main control chip is further configured to, after present compensation characteristic values of driving transistors of all pixels having a color obtained in a display cycle of the screen are stored, extract the present compensation characteristic values of the driving transistors of the pixels having the color to compensate corresponding pixels.

* * * * *